US012343781B2

(12) United States Patent
Sato et al.

(10) Patent No.: US 12,343,781 B2
(45) Date of Patent: Jul. 1, 2025

(54) BENDING SYSTEM AND CORRECTING METHOD FOR TOOL MISALIGNMENT

(71) Applicant: AMADA CO., LTD., Kanagawa (JP)

(72) Inventors: Masaaki Sato, Kanagawa (JP); Yohei Yamaguchi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 844 days.

(21) Appl. No.: 17/611,161

(22) PCT Filed: May 8, 2020

(86) PCT No.: PCT/JP2020/018709
§ 371 (c)(1),
(2) Date: Nov. 14, 2021

(87) PCT Pub. No.: WO2020/230731
PCT Pub. Date: Nov. 19, 2020

(65) Prior Publication Data

US 2022/0203429 A1 Jun. 30, 2022

(30) Foreign Application Priority Data

May 16, 2019 (JP) ..... 2019-092892
Aug. 7, 2019 (JP) ..... 2019-145149

(51) Int. Cl.
*B21D 37/14* (2006.01)
*B21D 5/00* (2006.01)
*B21D 5/02* (2006.01)

(52) U.S. Cl.
CPC ..... *B21D 5/0254* (2013.01); *B21D 5/004* (2013.01); *B21D 37/145* (2013.01); *Y10T 483/1731* (2015.01)

(58) Field of Classification Search
CPC ..... Y10T 483/1729; Y10T 483/1731; B21D 5/0254; B21D 37/145; B21D 5/004; B21D 5/0218
(Continued)

(56) References Cited

U.S. PATENT DOCUMENTS 5,410,904 A * 5/1995 Hirata ..... B21D 5/002 72/461
6,024,681 A * 2/2000 Latten ..... B21D 37/145 483/68
(Continued)

FOREIGN PATENT DOCUMENTS

AT 506296 B1 * 8/2009 ..... B21D 37/145
CN 101081478 A 12/2007
(Continued)

OTHER PUBLICATIONS

International Search Report for corresponding Application No. PCT/JP2020/018709, mailed Jun. 30, 2020.
(Continued)

*Primary Examiner* — Sunil K Singh
*Assistant Examiner* — Michael Vitale
(74) *Attorney, Agent, or Firm* — Renner, Otto, Boisselle & Sklar, LLP

(57) ABSTRACT

In a case where a vacant space exists on only one side in a holder area of a stocker positioned at an exchange position, a first upper tool exchange unit is first moved in the left-right direction, and located in the vicinity of the vacant space. Next, the first upper tool exchange unit is moved forward and thereafter moved to the left, so that a tool retention member of the first upper tool exchange unit is brought into contact with one side surface of a tool. Then, under the
(Continued)

contact state, the first upper tool exchange unit is moved to the right until the other side surface of the tool abuts on a stopper.

2 Claims, 19 Drawing Sheets

(58) Field of Classification Search
USPC ..... 483/28, 29
See application file for complete search history.

(56) References Cited

U.S. PATENT DOCUMENTS

| | | | | |
|---|---|---|---|---|
| 7,029,429 | B2 * | 4/2006 | Akami | B21D 5/02 700/165 |
| 7,168,286 | B1 | 1/2007 | Pelech | |
| 7,632,224 | B2 | 12/2009 | Rouweler et al. | |
| 10,399,133 | B2 * | 9/2019 | Felder | B23Q 11/0082 |
| 10,500,623 | B2 | 12/2019 | Meneghetti | |
| 10,507,505 | B2 * | 12/2019 | Fischereder | B23Q 3/1556 |
| 2003/0064871 | A1 | 4/2003 | Akami | |
| 2003/0069114 | A1 | 4/2003 | Akami | |
| 2003/0092547 | A1 | 5/2003 | Akami | |
| 2004/0157715 | A1 | 8/2004 | Akami | |
| 2007/0271987 | A1 | 11/2007 | Shimizu | |
| 2007/0297889 | A1 | 12/2007 | Rouweler | |
| 2009/0100896 | A1 | 4/2009 | Akami | |
| 2014/0326036 | A1 | 10/2014 | Hayashi | |
| 2015/0174633 | A1 | 6/2015 | Sato | |
| 2016/0354821 | A1 | 12/2016 | Meneghetti | |
| 2017/0239701 | A1 | 8/2017 | Denkmeier | |
| 2017/0297073 | A1 | 10/2017 | Sato | |

FOREIGN PATENT DOCUMENTS

| | | | | |
|---|---|---|---|---|
| CN | 105992658 | A | 10/2016 | |
| CN | 106 734 644 | A | 5/2017 | |
| DE | 100 60 405 | B4 | 3/2007 | |
| EP | 1 160 024 | A1 | 12/2001 | |
| EP | 1862255 | A1 | 12/2007 | |
| EP | 1925374 | A1 * | 5/2008 | B21D 37/145 |
| JP | S58 76326 | U | 5/1983 | |
| JP | 6-234018 | A | 8/1994 | |
| JP | H09 220618 | A | 8/1997 | |
| JP | 10-211521 | A | 8/1998 | |
| JP | 10-263708 | A | 10/1998 | |
| JP | 11-10235 | A | 1/1999 | |
| JP | H111023 | A | 1/1999 | |
| JP | 2000-71028 | A | 3/2000 | |
| JP | 2003-71519 | A | 3/2003 | |
| JP | 2004-337950 | A | 12/2004 | |
| JP | 2004-344918 | A | 12/2004 | |
| JP | 2006-000855 | A | 1/2006 | |
| JP | 2006-346707 | A | 12/2006 | |
| JP | 4558852 | B2 | 10/2010 | |
| JP | 4672868 | B2 | 4/2011 | |
| JP | 2013-86149 | A | 5/2013 | |
| JP | 2013-111610 | A | 6/2013 | |
| JP | 5252837 | B2 | 7/2013 | |
| JP | 2014-4604 | A | 1/2014 | |
| JP | 2014-91137 | A | 5/2014 | |
| JP | 2015-120185 | A | 7/2015 | |
| JP | 5841800 | B2 | 1/2016 | |
| JP | 2016-83673 | A | 5/2016 | |
| JP | 5947861 | B2 | 7/2016 | |
| JP | 2017-508623 | A | 3/2017 | |
| JP | 2018-001196 | A | 1/2018 | |
| JP | 2021090989 | A * | 6/2021 | B21D 37/04 |
| WO | 2008050458 | A1 | 5/2008 | |
| WO | 2015118505 | A3 | 8/2015 | |
| WO | 2016/023057 | A1 | 2/2016 | |
| WO | 2016/054668 | A1 | 4/2016 | |
| WO | 2017212386 | A1 | 12/2017 | |
| WO | 2018065965 | A1 | 4/2018 | |
| WO | WO-2018211381 | A1 * | 11/2018 | B21D 5/00 |
| WO | WO-2020246507 | A1 * | 12/2020 | B21D 37/145 |

OTHER PUBLICATIONS

Office Action for corresponding Japanese Patent Application No. 2019-145149, drafted Jun. 22, 2020.
International Search Report for Application No. PCT/JP2019/028035, mailed Oct. 21, 2019.
Extended European Search Report for EP Application No. 19837688.1, mailed Aug. 2, 2021.
Extended European Search Report for EP Application No. 19837570.1, mailed Aug. 12, 2021.
Extended European Search Report for EP Application No. 19838058.6, dated Aug. 6, 2021.
Extended European Search Report for EP Application No. 19838694.8, dated Aug. 6, 2021.
International Search Report for Application No. PCT/JP2019/028038, mailed Oct. 21, 2019.
International Search Report for Application No. PCT/JP2020/017895, mailed Jul. 7, 2020.
International Search Report for Application No. PCT/JP2019/028025, mailed Oct. 21, 2019.
International Search Report for Application No. PCT/JP2019/028031, mailed Oct. 21, 2019.
International Search Report for Application No. PCT/JP2019/028033, mailed Oct. 21, 2019.
European Search Report for corresponding Application No. 20805835.4, mailed May 30, 2022.
European Search Report for corresponding Application No. 20802239.2, mailed May 23, 2022.

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

BENDING SYSTEM AND CORRECTING METHOD FOR TOOL MISALIGNMENT

TECHNICAL FIELD

The present invention relates to a bending system for performing bending of a plate-shaped workpiece, and a correcting method for tool misalignment for correcting misalignment of a tool in a tool holder of a press brake or in a stocker positioned at an exchange position.

BACKGROUND ART

A bending system includes a tool storage that is disposed on the side of a press brake and stores a plurality of tools. The tool storage has a plurality of stockers. Each stocker is formed with a holder area for holding the plurality of tools along the left-right direction. The selected stocker is configured such that it can be positioned at an exchange position for tool exchange (automatic exchange). In addition, the tool storage has a stocker moving mechanism that moves the selected stocker to the exchange position. In particular, in a case of a stocker that stores upper tools, the stocker moving mechanism may invert the tools horizontally by swivel motion of the stocker immediately before positioning the stocker at the exchange position.

A bending system as disclosed in each of Patent Literatures 1 and 2 below includes a tool exchange unit that exchanges tools with respect to tool holders of a press brake and a stocker positioned at an exchange position. The tool exchange unit is provided on the back side of a table (an upper table, a lower table) of the press brake so as to be movable in the left-right direction. The tool exchange unit has a tool retention member that holds the tools, and the tool retention member is engageable-with and disengageable-from engagement holes of the tools. The bending system includes a servo motor as a moving actuator that moves the tool exchange unit in the left-right direction. The following Patent Literature 3 is also provided as a patent literature related to the background art of the present invention.

CITATION LIST

Patent Literature

Patent Literature 1: Japanese Patent No. 4672868
Patent Literature 2: Japanese Patent No. 5947861
Patent Literature 3: Japanese Patent No. 5841800

SUMMARY

When the stocker that is not full of tools is moved to the exchange position, misalignment of a tool from a regular arrangement position in the stocker is sometimes caused. In particular, when an operation of the stocker moving mechanism includes a horizontal reversal operation of the stocker, misalignment is likely to occur. The bending system cannot grasp the above misalignment of the tool, and cannot continue the automatic tool exchange operation. Even when the tool is pressed by a pressing member such as a ball plunger provided in the stocker, it is difficult to stably prevent the misalignment of the tool in the stocker positioned at the exchange position.

By pressurizing force at the time of bending, the lower table is deflected in a protruding shape, and the upper table is deflected in a recessed shape, and therefore outward force in the left-right direction is applied to the tool held in the tool holder. Therefore, as the number of times of bending increases, the misalignment of the tool from the regular arrangement position in the tool holder may occur. Furthermore, as the number of times of unclamping by the tool holder increases, there is a greater concern that the misalignment of the tool from the regular arrangement position in the tool holder occurs. In such a case, as described above, even when the tool misalignment in the tool holder occurs, the bending system cannot grasp the misalignment, and the bending system cannot continue the operation related to the automatic tool exchange.

An object of the present invention is to provide a bending system and a correcting method for tool misalignment that can correct misalignment of a tool in a stocker positioned at a tool holder or an exchange position of a press brake.

According to a first feature of the present invention, there is provided a bending system including: a tool storage disposed in a vicinity of a press brake and including a plurality of stockers, each of the plurality of stockers being formed with a holder area for holding a plurality of tools along a left-right direction, the tool storage being configured to be able to position a tool in a selected one of the plurality of stockers at an exchange position for exchanging the tool and configured to store the plurality of tools; a tool exchange unit provided on a back side or a front side of a table of the press brake so as to be movable in the left-right direction and including a tool retention member configured to hold the tool so as to be engageable-with and disengageable-from an engagement hole of the tool, the tool exchange unit being configured to exchange the tool with respect to a tool holder of the press brake and the stocker positioned at the exchange position; a moving actuator configured to move the tool exchange unit in the left-right direction; and a control device configured to control the tool exchange unit and the moving actuator such that the tool exchange unit moves in the left-right direction until the tool abuts on a stopper provided at a position corresponding to one end of a regular arrangement position in the stocker in a state in which the tool retention member is brought into contact with a side surface of the tool from a side of a vacant space in a case where the vacant space exists on only one side in the holder area of the stocker positioned at the exchange position.

According to a second feature of the present invention, there is provided a bending system including: a tool storage disposed in a vicinity of a press brake and including a plurality of stockers, each of the plurality of stockers being formed with a holder area for holding a plurality of tools along a left-right direction, the tool storage being configured to be able to position a tool in a selected one of the plurality of stockers at an exchange position for exchanging the tool and configured to store the plurality of tools; a pair of first and second tool exchange units each provided on a back side or a front side of a table of the press brake so as to be movable in the left-right direction and each including a tool retention member configured to hold the tool so as to be engageable-with and disengageable-from an engagement hole of the tool, the pair of first and second tool exchange units being each configured to exchange the tool with respect to a tool holder of the press brake and the stocker positioned at the exchange position; first and second moving actuators configured to move each of the first and second tool exchange units in the left-right direction; and a control device configured to control the first and second tool exchange units and the first and second moving actuators such that the first tool exchange unit moves to one side in the left-right direction until the first tool exchange unit reaches a position corresponding to one end of a regular arrangement position of the tool in the stocker in a state in which the tool retention member of the first tool exchange unit is brought into contact with one side surface of the tool, and the second tool exchange unit moves to the other side in the left-right direction until the second tool exchange unit reaches a position corresponding to the other end of the regular arrangement position in the stocker in a state in which the tool retention member of the second tool exchange unit is brought into contact with the other side surface of the tool in a case where vacant spaces exist on both sides in the holder area of the stocker positioned at the exchange position.

According to a third feature of the present invention, there is provided a bending system including: a tool storage configured to be disposed in a vicinity of a press brake and including a plurality of stockers, each of the plurality of stockers being formed with a holder area for holding a plurality of tools along a left-right direction, the tool storage being configured to be able to position a tool in a selected one of the plurality of stockers at an exchange position for exchanging the tool and configured to store the plurality of tools; a pair of first and second tool exchange units each provided on a back side or a front side of a table of the press brake so as to be movable in the left-right direction and each including a tool retention member configured to hold the tool so as to be engageable-with and disengageable-from an engagement hole of the tool, the pair of first and second tool exchange units being each configured to exchange the tool with respect to a tool holder of the press brake and the stocker positioned at the exchange position; first and second moving actuators configured to move each of the first and second tool exchange units in the left-right direction; and a control device configured to control the first and second tool exchange units and the first and second moving actuators such that the first tool exchange unit moves to one side in the left-right direction until the first tool exchange unit reaches a position corresponding to one end of a regular arrangement position of the tool in the tool holder in a state in which the tool retention member of the first tool exchange unit is brought into contact with one side surface of the tool, and the second tool exchange unit moves to the other side in the left-right direction until the second tool exchange unit reaches a position corresponding to the other end of the regular arrangement position in the tool holder in a state in which the tool retention member of the second tool exchange unit is brought into contact with the other side surface of the tool in a case where misalignment of the tool held in the tool holder occurs or is estimated to occur.

According to a fourth feature of the present invention, there is provided a bending system including: a tool storage configured to be disposed in a vicinity of a press brake and including a plurality of stockers, each of the plurality of stockers being formed with a holder area for holding a plurality of tools along a left-right direction, the tool storage being configured to be able to position a tool in a selected one of the plurality of stockers at an exchange position for exchanging the tool and configured to store the plurality of tools; a pair of first and second tool exchange units each provided on a back side or a front side of a table of the press brake so as to be movable in the left-right direction and each including a tool retention member engageable-with and disengageable-from an engagement hole of the tool and holding the tool, the pair of first and second tool exchange units being each configured to exchange the tool with respect to a tool holder of the press brake and the stocker positioned at the exchange position; first and second moving actuators configured to move each of the first and second tool exchange units in the left-right direction; and a control device configured to control the first and second tool exchange units and the first and second moving actuators such that the first tool exchange unit moves to one side in the left-right direction until the first tool exchange unit reaches a position corresponding to one end of a temporary arrangement position of the plurality of tools in the tool holder in a state in which the tool retention member of the first tool exchange unit is brought into contact with one side surface of any tool of the plurality of tools, and the second tool exchange unit moves to the other side in the left-right direction until the second tool exchange unit reaches a position corresponding to the other end of the temporary arrangement position in the tool holder in a state in which the tool retention member of the second tool exchange unit is brought into contact with the other side surface of a remaining one of the plurality of tools, on a condition that the tool retention member is not able to be inserted between the plurality of tools, in a case where misalignment of the plurality of tools held at intervals in the left-right direction in the tool holder occurs or is estimated to occur.

According to a fifth feature of the present invention, there is provided a correcting method for tool misalignment including: using a tool exchange unit provided on a back side or a front side of a table of a press brake so as to be movable in a left-right direction; and moving the tool exchange unit in the left-right direction until a tool abuts on a stopper provided at a position corresponding to one end of a regular arrangement position in a stocker of a plurality of stockers in a tool storage disposed in a vicinity of the press brake in a state in which a tool retention member of the tool exchange unit is brought into contact with a side surface of the tool from a side of a vacant space in a case where the vacant space exists on only one side in a holder area of the stocker positioned at the exchange position for exchanging the tool.

According to a sixth feature of the present invention, there is provided a correcting method for tool misalignment including: using a pair of first and second tool exchange units each provided on a back side or a front side of a table of a press brake so as to be movable in a left-right direction; and moving the first tool exchange unit to one side in the left-right direction until the first tool exchange unit reaches a position corresponding to one end of a regular arrangement position of a tool in a stocker of a plurality of stockers in a tool storage disposed in a vicinity of the press brake in a state in which a tool retention member of the first tool exchange unit is brought into contact with one side surface of the tool, and moving the second tool exchange unit to the other side in the left-right direction until the second tool exchange unit reaches a position corresponding to the other end of the regular arrangement position in the stocker in a state in which a tool retention member of the second tool exchange unit is brought into contact with the other side surface of the tool in a case where vacant spaces exist on both sides in a holder area of the stocker positioned at the exchange position for exchanging the tool.

According to a seventh feature of the present invention, there is provided a correcting method for tool misalignment including: using a pair of first and second tool exchange units each provided on a back side or a front side of a table of a press brake so as to be movable in a left-right direction; and moving the first tool exchange unit to one side in the left-right direction until the first tool exchange unit reaches a position corresponding to one end of a regular arrangement position of a tool in a tool holder of the press brake in a state in which a tool retention member of the first tool exchange unit is brought into contact with one side surface of the tool, and moving the second tool exchange unit to the other side in the left-right direction until the second tool exchange unit reaches a position corresponding to the other end of the regular arrangement position in the tool holder in a state in which the tool retention member of the second tool exchange unit is brought into contact with the other side surface of the tool in a case where misalignment of the tool held in the tool holder occurs or is estimated to occur.

According to an eighth feature of the present invention, there is provided a correcting method for tool misalignment including: using a pair of first and second tool exchange units each provided on a back side or a front side of a table of a press brake so as to be movable in a left-right direction; and moving the first tool exchange unit to one side in the left-right direction until the first tool exchange unit reaches a position corresponding to one end of a temporary arrangement position of a plurality of tools in a tool holder of the press brake in a state in which a tool retention member of the first tool exchange unit is brought into contact with one side surface of any tool of the plurality of tools, and moving the second tool exchange unit to the other side in the left-right direction until the second tool exchange unit reaches a position corresponding to the other end of the temporary arrangement position in the tool holder in a state in which the tool retention member of the second tool exchange unit is brought into contact with the other side surface of a remaining one of the plurality of tools, on a condition that the tool retention member of the first tool exchange unit is not able to be inserted between the plurality of tools, in a case where misalignment of the plurality of tools held at intervals in the left-right direction in the tool holder occurs or is estimated to occur.

DESCRIPTION OF EMBODIMENTS

Figure 1:
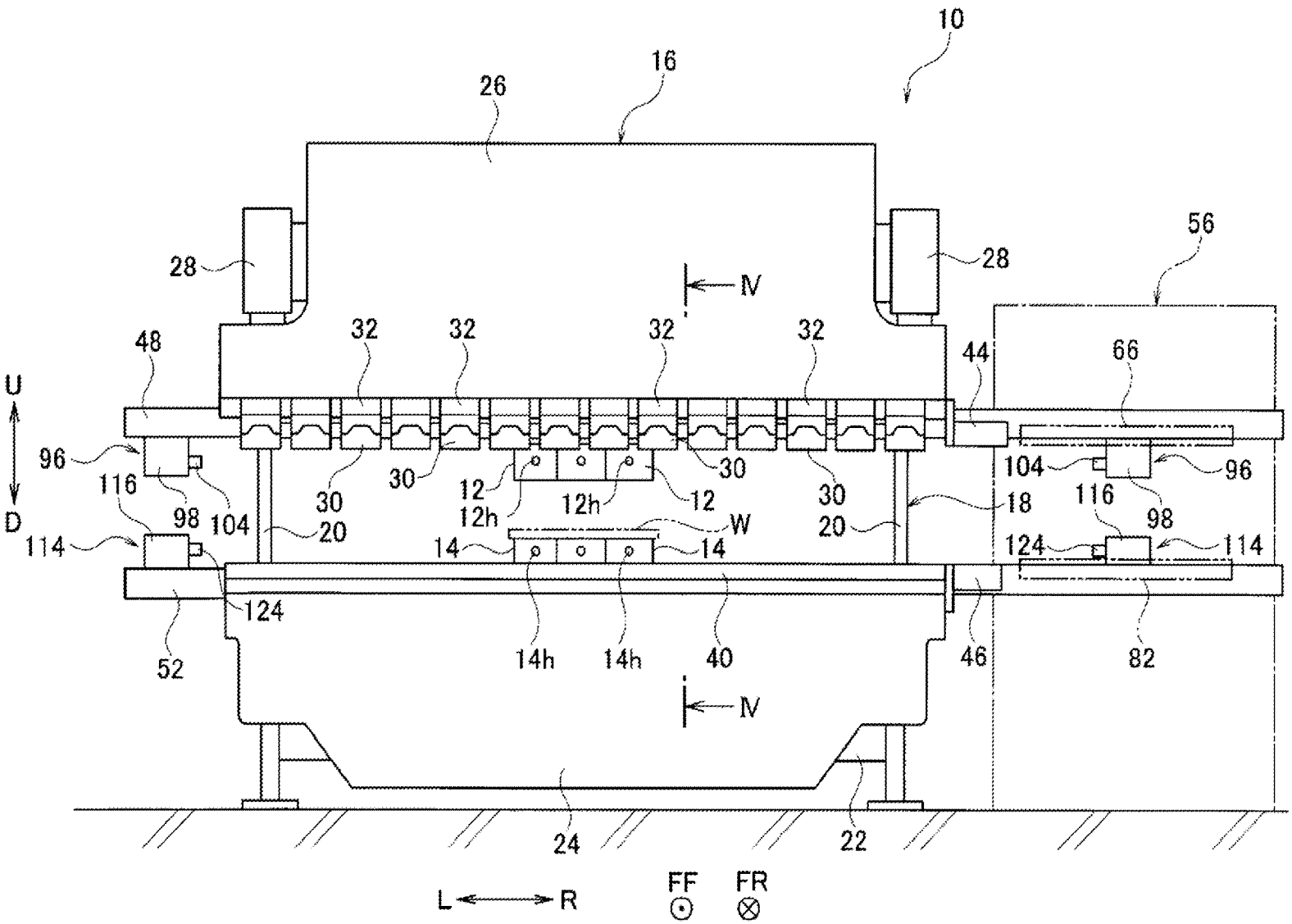
FIG. 1 is a front view schematically illustrating a bending system according to an embodiment.

Embodiments of the present invention will be described with reference to FIG. 1 to FIG. 100.

The "left-right direction" is one of horizontal directions and is a lateral direction of a press brake or a tool storage. The "front-rear direction" is one of the horizontal directions and is a direction orthogonal to the left-right direction. The term "tool" includes an upper tool and a lower tool. In the drawing, "FF" indicates a forward direction, "FR" indicates a rearward direction, "L" indicates a left direction, "R" indicates a right direction, "U" indicates an upward direction, and "D" indicates a downward direction.

As illustrated in FIG. 1 to FIG. 4, a bending system 10 according to this embodiment is a system for bending a plate-shaped workpiece (sheet metal) W by using automatically exchangeable punch tools 12 as upper tools and die tools 14 as lower tools. An engagement hole 12*h* having a circular hole shape or an elongated hole shape is formed at the center in the lateral direction of each punch tool 12 so as to penetrate. An engagement groove 12*g* for anti-drop is formed in a shank 12*s* as a base of each punch tool 12 (see FIG. 4). An engagement hole 14*h* having a circular hole shape or an elongated hole shape is formed at the center in the lateral direction of each die tool 14 so as to penetrate (see FIG. 4).

The bending system 10 includes a press brake 16 that bends the work piece W in cooperation with the punch tools 12 and the die tools 14. First, a configuration of the press brake 16 will be specifically described.

The press brake 16 includes a main frame 18. The main frame 18 has a pair of side plates 20 that are separated and face each other in the left-right direction, and a plurality of beam members 22 that connect the pair of side plates 20. A lower table 24 extending in the left-right direction is provided at a lower portion of the main frame 18. On the upper portion of the main frame 18, an upper table 26 extending in the left-right direction is provided so as to be vertically movable. A hydraulic cylinder 28 is provided on each of the upper portions of the side plates 20, as a moving actuator for vertical movement that moves the upper table 26 vertically. Instead of configuring such that the upper table 26 is vertically movable, the lower table 24 may be configured to be vertically movable. A servo motor may be used instead of the hydraulic cylinder 28 as the moving actuator for vertical movement.

On a lower end portion of the upper table 26, a plurality of upper tool holders 30 that hold the punch tools 12 detachably and attachably are mounted at intervals in the left-right direction. Each upper tool holder 30 is secured to the upper table 26 by a fixture plate (fastening plate) 32. The upper tool holder 30 has a configuration disclosed in, for example, Patent Literature 3 and includes a holder main body 34. On the front side of each holder main body 34, a front clamp plate 6 that presses the shank 12*s* of the punch tool 12 backward is provided so as to be swingable. The front clamp plate 36 can clamp and unclamp the punch tool 12. The front clamp plate 36 has a pawl 36*c* that can be engaged with the engagement groove 12*g* of the punch tool 12 on the lower end side thereof. Further, on the rear side of the holder main body 34, a rear clamp plate 38 that presses the shank 12*s* of the horizontally inverted punch tool 12 forward is provided so as to be swingable. The rear clamp plate 38 can clamp and unclamp the punch tool 12. The rear clamp plate 38 has a pawl 38*c* that can be engaged with the engagement groove 12*g* of the punch tool 12 on the lower end side thereof.

The clamping operation and the unclamping operation of the plurality of front clamp plates 36 are performed in synchronization. Even when the front clamp plates 36 unclamp the punch tools 12, the punch tools 12 do not fall from the upper tool holders 30. Similarly, the clamping operation and the unclamping operation of the plurality of rear clamp plates 38 are also performed in synchronization. Even when the rear clamp plates 38 unclamp the punch tools 12, the punch tools 12 do not fall from the upper tool holders 30.

In an upper end of the lower table 24, a lower tool holder 40 that holds the die tools 14 detachably and attachably is provided. The lower tool holder 40 extends in the left-right direction. The lower tool holder 40 has a configuration disclosed in, for example, the aforementioned Patent Literature 2 or 3. In the lower tool holder 40, a holder groove 40*g* that allows shanks 14*s* of the die tools 14 to be inserted is formed along the left-right direction. The lower tool holder 40 has a clamper 42 that secures (presses) the shanks 14*s*.

An upper joint block 44 that extends in the left-right direction is provided on a right side portion of the upper table 26. In the upper joint block 44, a joint groove 44*g* that allows the shanks 12*s* of the punch tools 12 to be inserted is formed along the left-right direction. The joint groove 44*g* is continuous to clearances between the holder main bodies 34 and the front clamp plates 36 in the left-right direction (the joint groove 44*g* and the clearances extend in line).

A lower joint block 46 that extends in the left-right direction is provided on a right side portion of the lower table 24. In the lower joint block 46, a joint groove 46*g* that allows the shanks 14*s* of the die tools 14 to be inserted is formed along the left-right direction. The joint groove 46*g* is continuous to the holder groove 40*g* of the lower tool holder 40 in the left-right direction (the joint groove 46*g* and the holder groove 40*g* extend in line).

Figure 4:
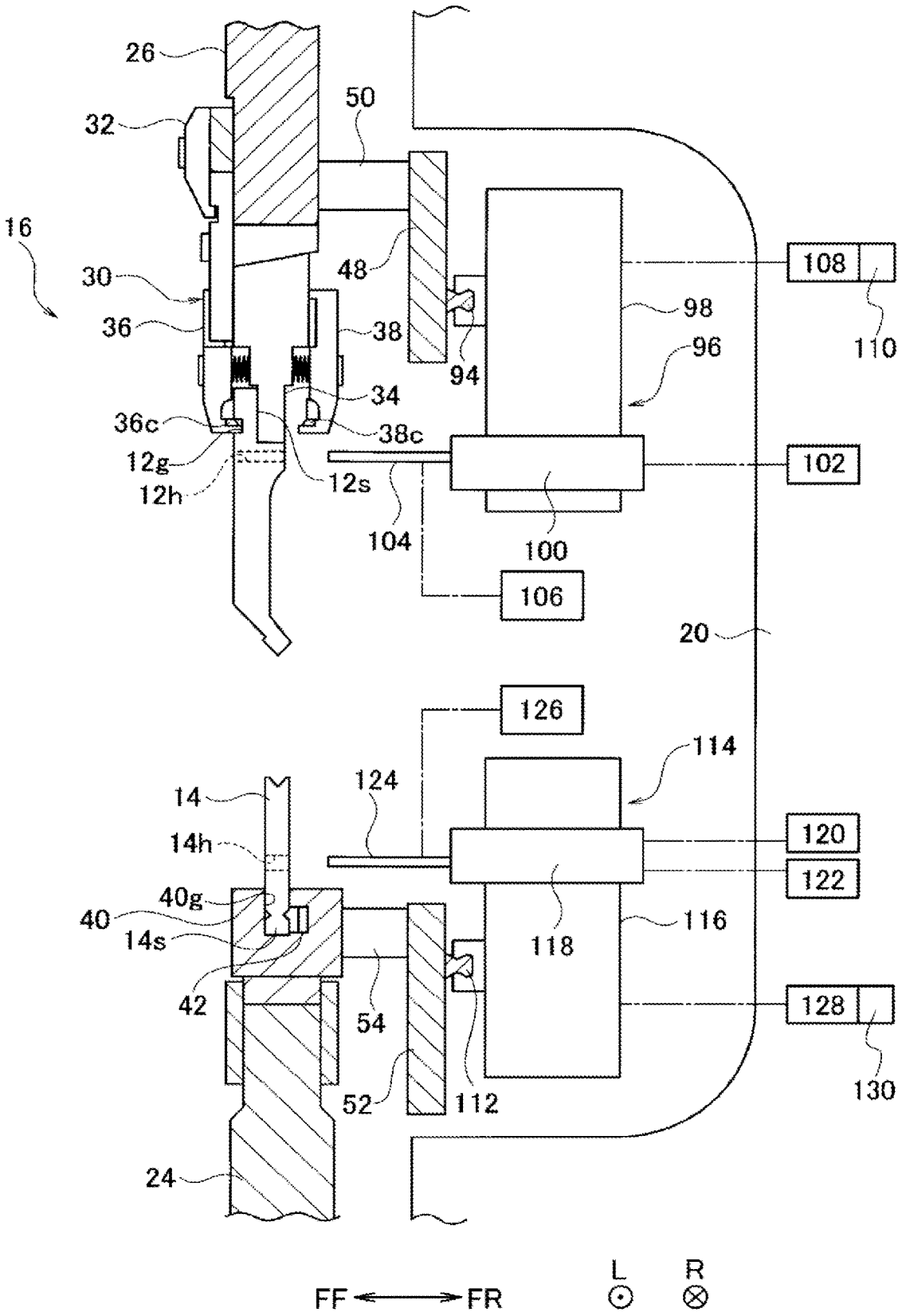
FIG. 4 is an enlarged sectional view taken along a line IV-IV in FIG. 1.

A back surface of the upper table 26 is secured to an upper supporting beam 48 extending in the left-right direction via a plurality of brackets 50 (only one is illustrated in FIG. 4). The upper supporting beam 48 protrudes to the right beyond the upper joint block 44. A back surface of the lower table 24 is secured to a lower supporting beam 52 extending in the left-right direction via a plurality of brackets 54 (only one is illustrated in FIG. 4). The lower supporting beam 52 protrudes to the right beyond the lower joint block 46.

Figure 2:
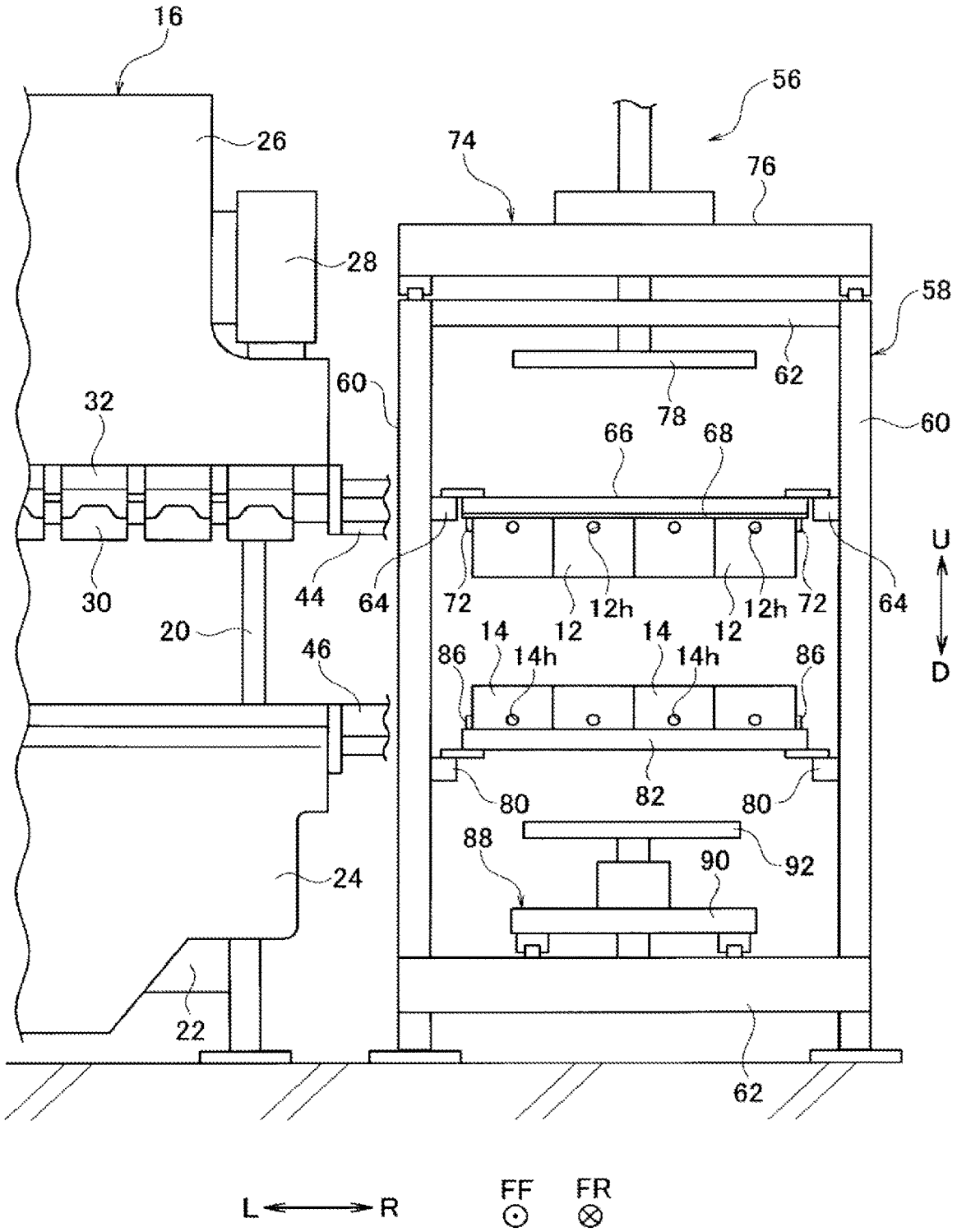
FIG. 2 is a front view schematically illustrating a tool storage.
Figure 3:
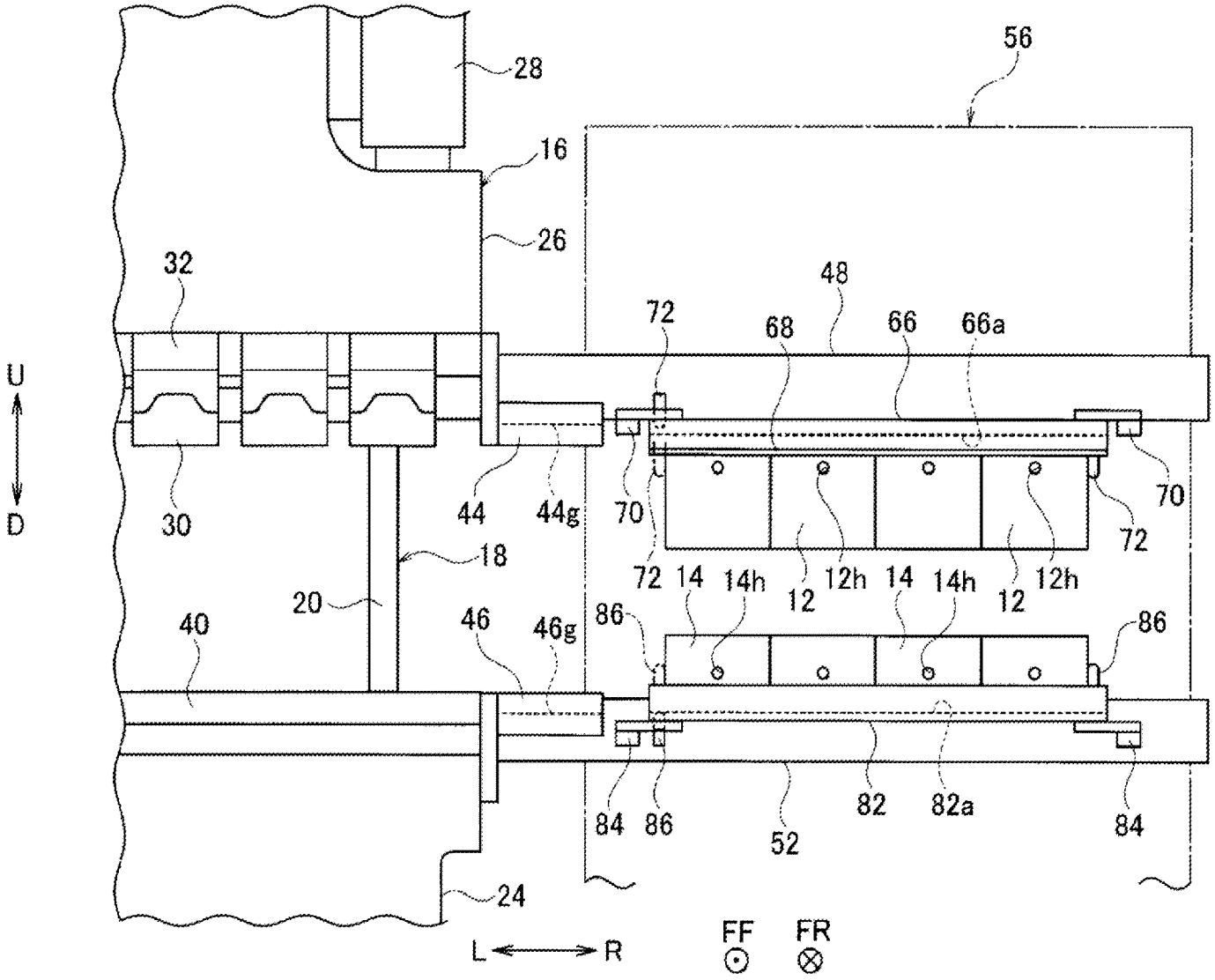
FIG. 3 is a front view schematically illustrating a stocker (an upper stocker and a lower stocker) positioned at a tool exchange position.

As illustrated in FIG. 2 and FIG. 3, a tool storage 56 that stores a plurality of punch tools 12 and a plurality of die tools 14 is disposed on the lateral side in the left-right direction of the press brake 16 (an example of the vicinity of the press brake 16). The tool storage 56 has, for example, a configuration similar to the configuration disclosed in Patent Literature 1 or 2. Now, the configuration of the tool storage 56 will be described.

As illustrated in FIG. 1 and FIG. 2, the tool storage 56 has a storage frame 58 erected on the lateral side (right side) in the left-right direction of the press brake 16. The storage frame 58 includes a plurality of columns 60 and a plurality of connecting beams 62 that connect the columns 60 and extend in the left-right direction or the front-rear direction.

A pair of upper storage plates 64 extending in the front-rear direction are provided on an upper portion of the storage frame 58 so as to be separated from each other in the left-right direction. A plurality of upper stockers 66 (only one is illustrated) holding the plurality of punch tools 12 are supported between the pair of upper storage plates 64. The plurality of upper stockers 66 are arranged in parallel with each other in the front-rear direction. Each upper stocker 66 extends in the left-right direction. In the upper stocker 66, a holder area (holding portion) 66*a* for holding the shanks 12*s* of the plurality of punch tools 12 is formed along the left-right direction. The upper stocker 66 has an engagement plate 68 that can be engaged with the engagement grooves 12*g* of the punch tools 12. The engagement plate 68 extends in the left-right direction. The selected upper stocker 66 is configured to be able to be positioned at an upper exchange position for exchanging the punch tools 12. The upper stocker 66 positioned at the upper exchange position is supported by a pair of upper receiving members 70 provided on the right end side of a front surface of the upper supporting beam 48.

Stoppers 72 for restricting the movement of the punch tools 12 in the left-right direction are provided at positions corresponding to both ends of a regular arrangement position of the plurality of punch tools 12 in the upper stocker 66. Each stopper 72 is configured to release the restricted state by moving upward when the stopper 72 is positioned on the side of the upper joint block 44 at the upper exchange position (the left end side of the upper exchange position).

The tool storage 56 has an upper stocker moving mechanism 74 that moves the selected upper stocker 66 to the upper exchange position. The upper stocker moving mechanism 74 can also horizontally reverse the upper stocker 66 by swivel motion immediately before positioning the upper stocker 66 in the upper exchange position. The upper stocker moving mechanism 74 has an upper carriage 76 provided above the storage frame 58 so as to be movable in the front-rear direction. The upper carriage 76 extends in the left-right direction. The upper stocker moving mechanism 74 has an upper stocker holding member 78 that is provided on the upper carriage 76 so as to be vertically movable and holds the upper stocker 66 from above. The upper stocker holding member 78 extends in the horizontal direction and is configured to be swivelable around a vertical axis. The movement operation and the swivel motion of the upper stocker 66 by the upper stocker moving mechanism 74 are known, and therefore description thereof will be omitted.

A pair of lower storage plates 80 extending in the front-rear direction are provided on a lower portion of the storage frame 58 so as to be separated from each other in the left-right direction. A plurality of lower stockers 82 (only one is illustrated) holding the plurality of die tools 14 are supported between the pair of lower storage plates 80. The plurality of lower stockers 82 are arranged in the front-rear direction. Each lower stocker 82 extends in the left-right direction. In the lower stocker 82, a holder area 82*a* for holding the shanks 14*s* of the plurality of die tools 14 is formed along the left-right direction. The selected lower stocker 82 is configured to be able to be positioned at a lower exchange position for exchanging the die tools 14. The lower stocker 82 positioned at the lower exchange position is supported by a pair of lower receiving members 84 provided on the right end side of a front surface of the lower supporting beam 52.

Stoppers 86 for restricting the movement of the die tools 14 in the left-right direction are provided at positions corresponding to both ends of a regular arrangement position of the plurality of die tools 14 in the lower stocker 82. The stopper 86 on the left side is configured to release the restricted state by moving downward when the stopper 86 is positioned on the side of the lower joint block 46 at the lower exchange position (the left end side of the lower exchange position).

The tool storage 56 has a lower stocker moving mechanism 88 that moves the selected lower stocker 82 to the lower exchange position. The lower stocker moving mechanism 88 has a lower carriage 90 provided below the storage frame 58 so as to be movable in the front-rear direction. The lower stocker moving mechanism 88 has a lower stocker holding member 92 that is provided on the lower carriage 90 so as to be vertically movable and holds the lower stocker 82 from below. The movement operation of the lower stocker 82 by the lower stocker moving mechanism 88 is known, and therefore description thereof will be omitted.

As illustrated in FIG. 1, FIG. 3 and FIG. 4, an upper guide rail 94 extending in the left-right direction is mounted on a back surface (rear surface) of the upper supporting beam 48. A pair of upper tool exchange units 96 that perform exchange of the punch tools 12 with respect to the plurality of upper tool holders 30 and the upper stocker 66 positioned at the upper exchange position are provided in the upper guide rail 94 so as to be movable in the left-right direction. That is, each upper tool exchange unit 96 is provided on the back side of the upper table 26 so as to be movable in the left-right direction via the upper supporting beam 48 and the upper guide rail 94. Each upper tool exchange unit 96 transports the punch tools 12 between the plurality of upper tool holders 30 and the upper stocker 66 positioned at the upper exchange position. The pair of upper tool exchange units 96 are composed of first and second upper tool exchange units 96 (A precedingly moved one is the "first" upper tool exchange unit.). The first and second upper tool exchange units 96 have the same configuration, and therefore one of the upper tool exchange units will be described as follows.

The upper tool exchange unit 96 has a configuration similar to the configuration disclosed in Patent Literature 2. The upper tool exchange unit 96 has an upper unit main body 98 provided on the upper guide rail 94 so as to be movable in the left-right direction, and an upper support member 100 provided on the upper unit main body 98. The upper support member 100 can be moved in the front-rear direction with respect to the upper unit main body 98 by driving an air cylinder 102 as a moving actuator for horizontal movement (front-rear movement) provided in the upper unit main body 98. The upper support member 100 may be configured to be vertically movable with respect to the upper unit main body 98.

The upper tool exchange unit 96 also has an upper tool retention member 104 that is provided in the upper support member 100 so as to be movable in the front-rear direction and holds the punch tool 12. A tip side of the upper tool retention member 104 is formed in a round-bar shape or a hook shape. The upper tool retention member 104 is engageable-with and disengageable-from the engagement hole 12*h* of the punch tool 12. The upper tool retention member 104 moves in the front-rear direction with respect to the upper support member 100 by driving an air cylinder 106 as another moving actuator for horizontal movement (front-rear movement) provided in the upper support member 100.

The upper unit main body 98 is provided with a servo motor 108 as a moving actuator for horizontal movement (left-right movement) that moves the upper tool exchange unit 96 in the left-right direction. The servo motor 108 has an encoder 110 as a position detector for detecting the position in the left-right direction of the upper tool exchange unit 96 (each upper tool retention member 104). The servo motor 108 and the encoder 110 corresponding to the first upper tool exchange unit 96 are a first servo motor 108 and a first encoder 110, respectively. Similarly, the servo motor 108 and the encoder 110 corresponding to the second upper tool exchange unit 96 are a second servo motor 108 and a second encoder 110, respectively.

A lower guide rail 112 extending in the left-right direction is mounted on a back surface of the lower supporting beam 52. A pair of lower tool exchange units 114 that perform exchange of the die tools 14 with respect to a lower tool holder 40 and the lower stocker 82 positioned at the lower exchange position are provided in the lower guide rail 112 so as to be movable in the left-right direction. That is, each lower tool exchange unit 114 is provided on the back side of the lower table 24 so as to be movable in the left-right direction via the lower supporting beam 52 and the lower guide rail 112. Each lower tool exchange unit 114 transports the die tools 14 between the lower tool holder 40 and the lower stocker 82 positioned at the lower exchange position. The pair of lower tool exchange units 114 are composed of first and second lower tool exchange units 114 (A precedingly moved one is the "first" lower tool exchange unit.). The first and second lower tool exchange units 114 have the same configuration, and therefore one of the lower tool exchange units will be described as follows.

The lower tool exchange unit 114 has a configuration similar to the configuration disclosed in Patent Literature 1. The lower tool exchange unit 114 has a lower unit main body 116 provided on the lower guide rail 112 so as to be movable in the left-right direction, and a lower support member 118 provided on the lower unit main body 116. The lower support member 118 moves in the front-rear direction with respect to the lower unit main body 116 by driving an air cylinder 120 as a moving actuator for horizontal movement (front-rear movement) provided in the lower unit main body 116. Further, the lower support member 118 moves vertically with respect to the lower unit main body 116 by driving an air cylinder 122 as a moving actuator for vertical movement provided in the lower unit main body 116.

The lower tool exchange unit 114 also has a lower tool retention member 124 that is provided in the lower support member 118 so as to be movable in the front-rear direction and holds the die tool 14. A tip side of the lower tool retention member 124 is formed in a round-bar shape or a hook shape. The lower tool retention member 124 is engageable-with and disengageable-from the engagement hole **14*h* of the die tool 14. The lower tool retention member 124 moves in the front-rear direction with respect to the lower support member 118 by driving an air cylinder 126 as another moving actuator for horizontal movement (front-rear movement) provided in the lower support member 118**.

The lower unit main body 116 is provided with a servo motor 128 as a moving actuator for horizontal movement (left-right movement) that moves the lower tool exchange unit 114 in the left-right direction. The servo motor 128 has an encoder 130 as a position detector for detecting the position in the left-right direction of the lower tool exchange unit 114 (each lower tool retention member 124). The servo motor 128 and the encoder 130 corresponding to the first lower tool exchange unit 114 are a first servo motor 128 and a first encoder 130, respectively. Similarly, the servo motor 128 and the encoder 130 corresponding to the second lower tool exchange unit 114 are a second servo motor 128 and a second encoder 130, respectively.

Figure 5:
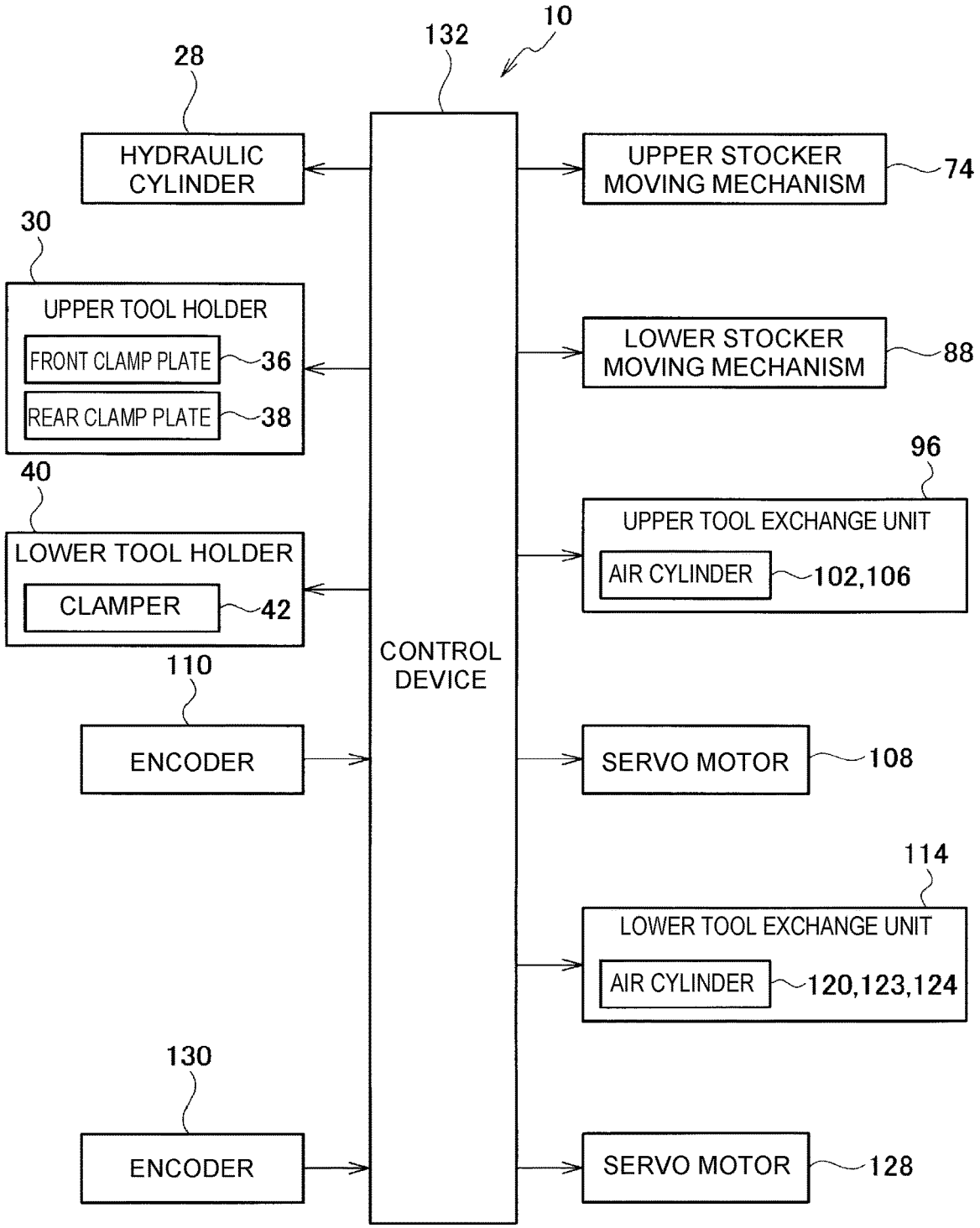
FIG. 5 is a block diagram of a bending system.

As illustrated in FIG. 5, the bending system 10 includes a control device (NC device) 132 that controls the hydraulic cylinder 28 and the like on the basis of a processing program, and controls the upper tool exchange units 96 and the like on the basis of a tool exchange program. The control device 132 is configured by a computer. The above encoders 110 and 130 and the like are connected to the control device 132. The control device 132 has a memory (not illustrated) for storing the processing program, the tool exchange program, and the like, and a CPU (not illustrated) for executing the processing program and the tool exchange program.

Figure 6A:
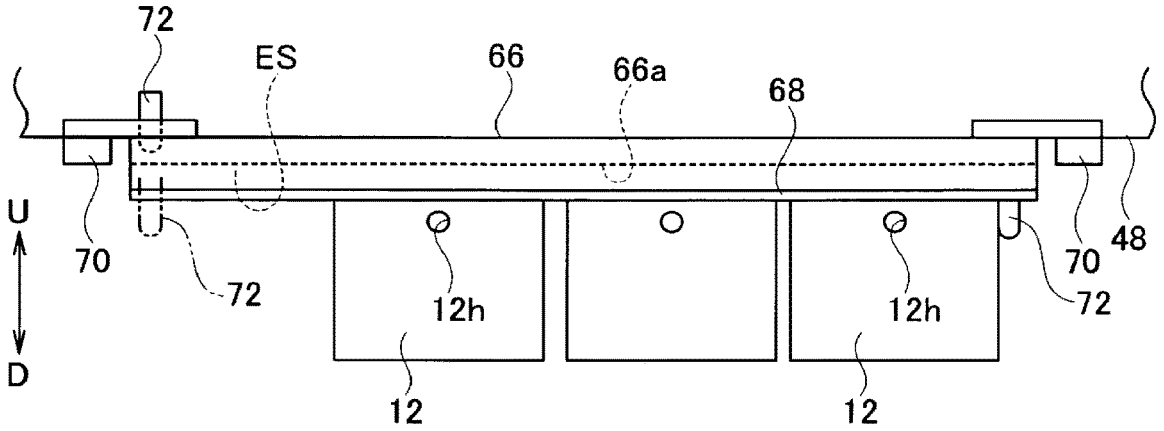
FIG. 6A(a) is a front view illustrating a state in which a vacant space exists on only one side in a holder area of the upper stocker positioned at an upper exchange position, and FIG. 6A(b) is a front view illustrating a state in which misalignment is already corrected.
Figure 6A:
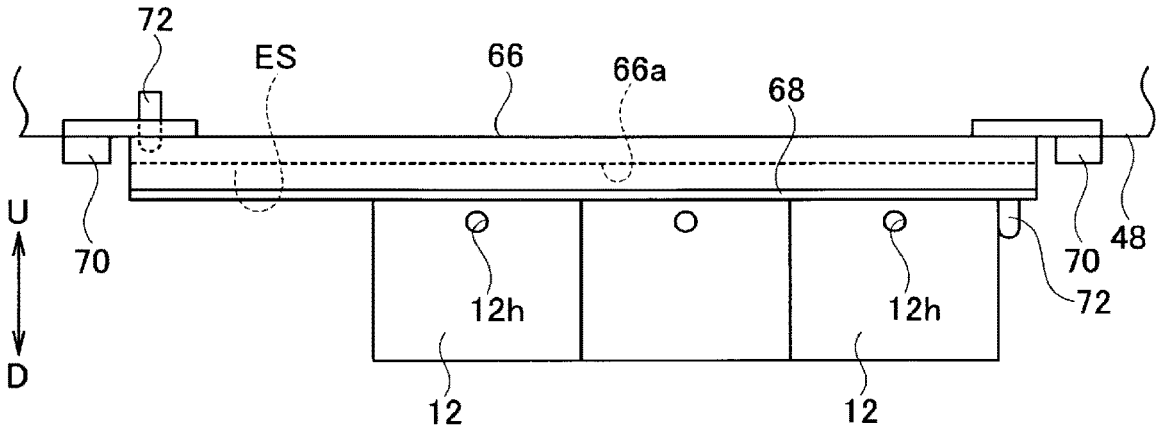
Figure 6A:
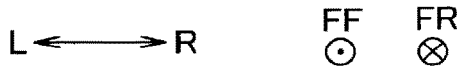

[A] As illustrated in FIG. 5 and FIG. 6A, when a vacant space ES exists on only one side (left side) in the holder area **66*a* of the upper stocker 66 positioned at the upper exchange position (see FIG. 6A(a)), the control device 132 executes a misalignment correcting operation of the punch tools 12 as follows. Whether or not the vacant space exists on the one side in the holder area 66*a* is determined by the control device 132 on the basis of arrangement information of the punch tools 12 in the upper stocker 66** included in the tool exchange program.

Figure 6B:
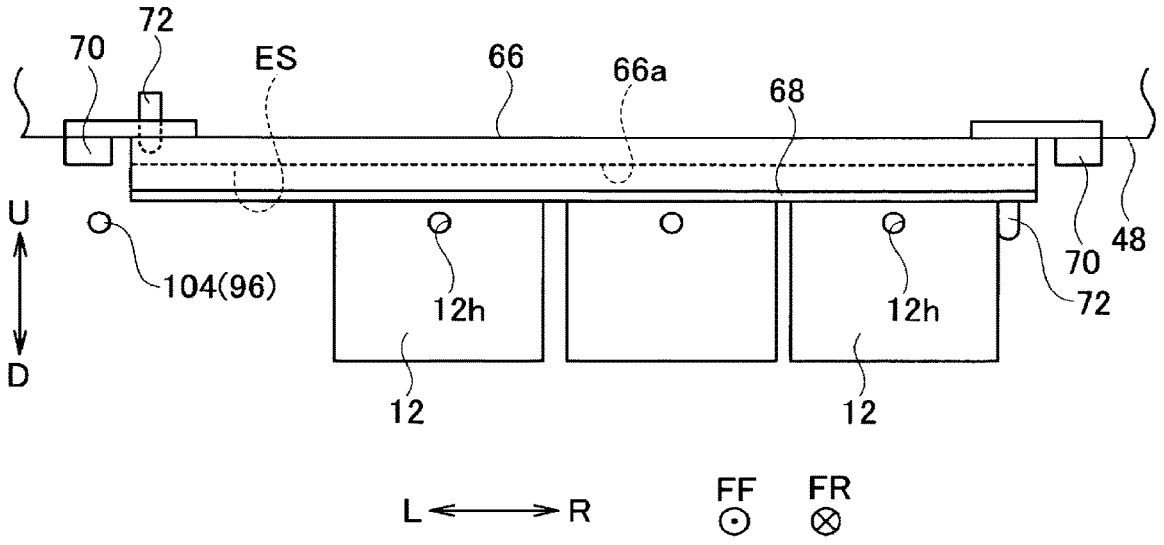
FIG. 6B(a) is a front view illustrating a misalignment correcting operation [before correction] in the upper stocker, and FIG. 6B(b) is a perspective view thereof.
Figure 6B:
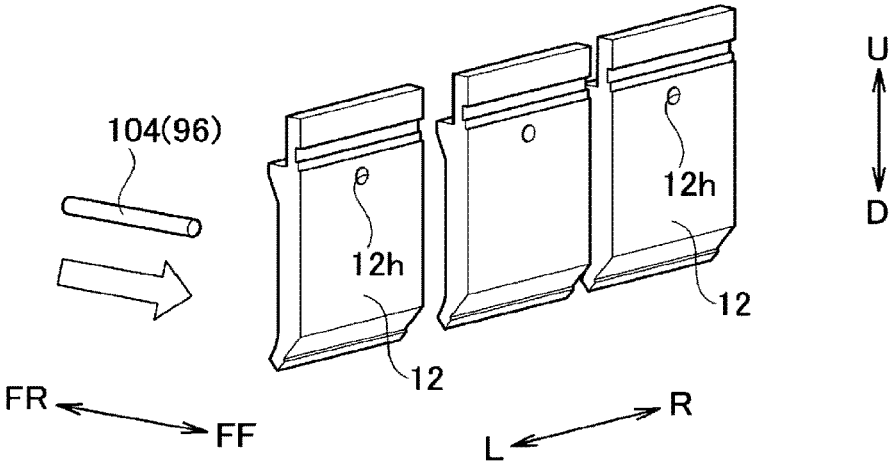
Figure 6C:
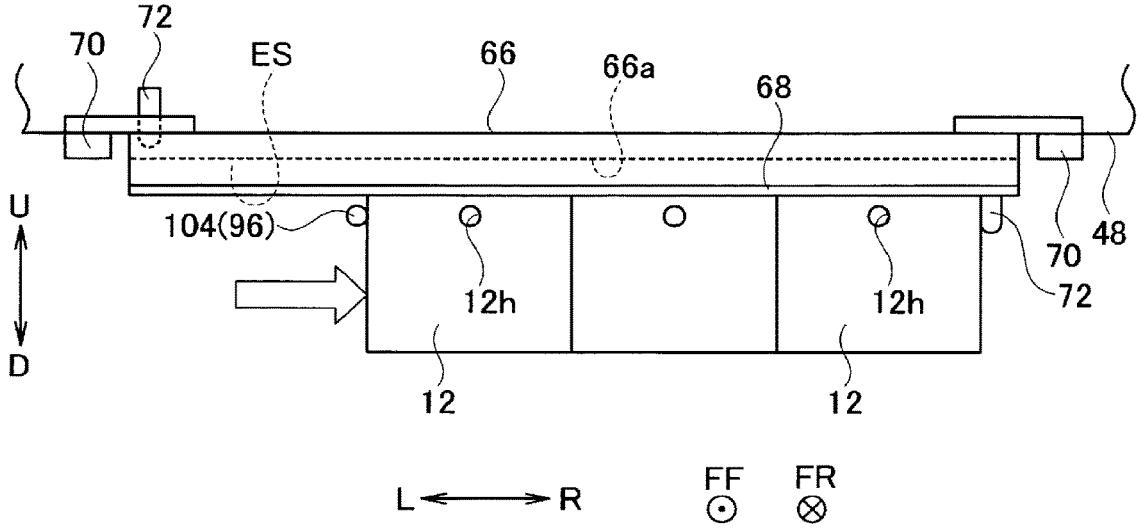
FIG. 6C(a) is a front view illustrating the misalignment correcting operation [after correction], and FIG. 6C(b) is a perspective view thereof.
Figure 6C:
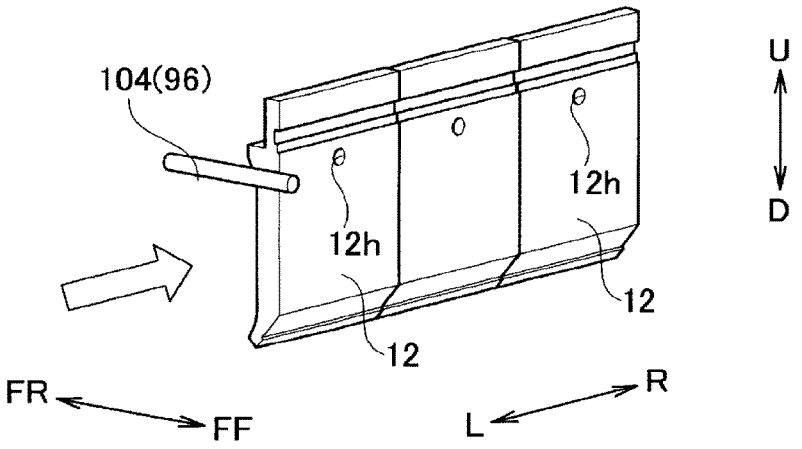

As illustrated in FIG. 3, FIG. 5, FIG. 6B and FIG. 6C, the control device 132 controls the first servo motor 108 such that the first upper tool exchange unit 96 is located in the vicinity of the vacant space ES, while obtaining a detection result of the first encoder 110 (see FIG. 6B(a) and (b)). Subsequently, the control device 132 controls the first upper tool exchange unit 96 such that the upper tool retention member 104 of the first upper tool exchange unit 96 is moved forward with respect to the upper unit main body 98 so as to face the side surface of the left punch tool 12 (punch tool 12 on the press brake 16 side). Furthermore, the control device 132 controls the first servo motor 108 such that the upper tool retention member 104 comes into contact with the side surface of the left punch tool 12. The control device 132 controls the first servo motor 108 such that the first upper tool exchange unit 96 moves to the right until the side surface of the right punch tool (punch tool 12 on the side opposite to the press brake 16) abuts on the stopper 72 (see FIG. 6C(a) and FIG. 6C(b)).

Figure 7A:
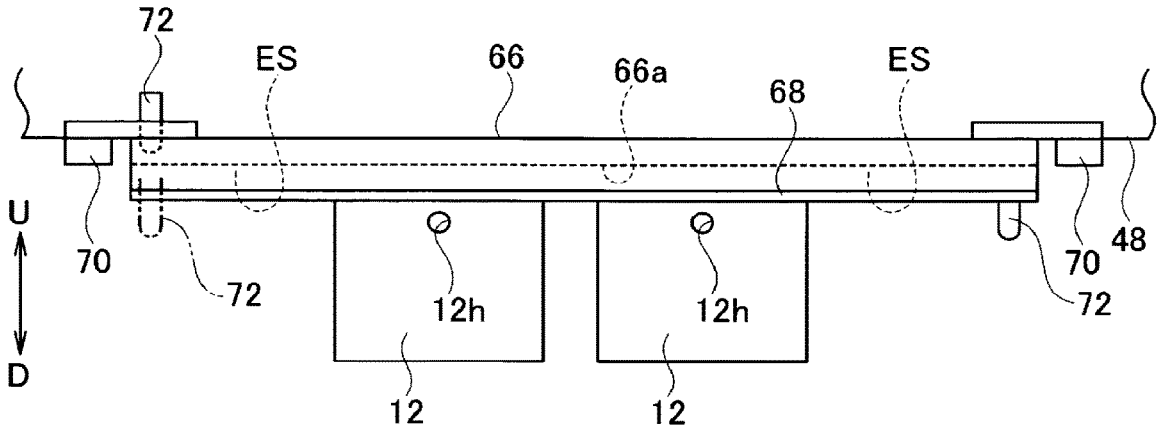
FIG. 7A(a) is a front view illustrating a state in which vacant spaces exist on both sides in the holder area of the upper stocker positioned at the upper exchange position, and FIG. 7A(b) is a front view illustrating a state in which misalignment is already corrected.
Figure 7A:
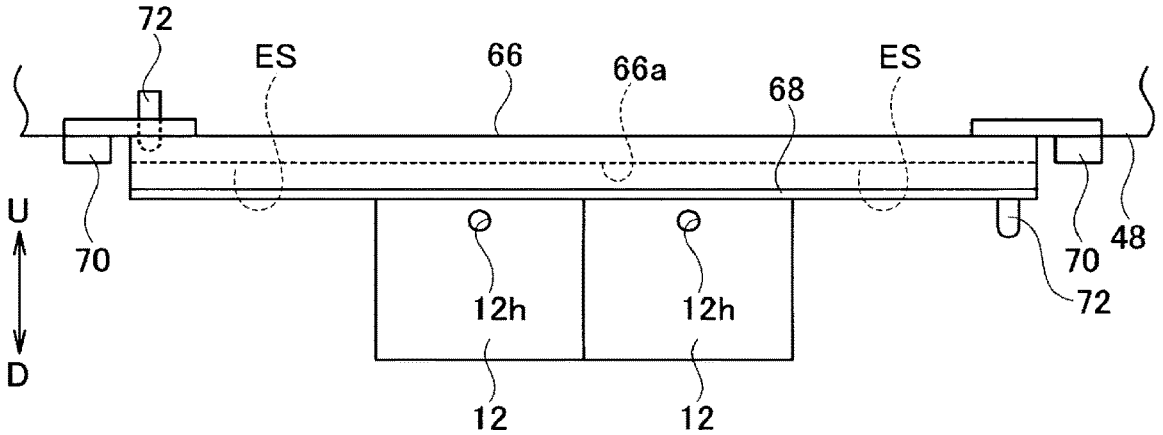
Figure 7A:
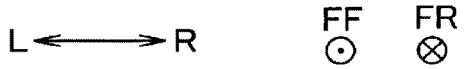

[B] As illustrated in FIG. 5 and FIG. 7A, when vacant spaces ES exist on both sides (right and left sides) in the holder area **66*a* of the upper stocker 66 positioned at the upper exchange position (see FIG. 7A(a)), the control device 132 executes a misalignment correcting operation of the punch tools 12 as follows. Whether or not the vacant spaces exist on the both sides in the holder area 66*a* is determined by the control device 132 on the basis of arrangement information of the punch tools 12 in the upper stocker 66** included in the tool exchange program.

Figure 7B:
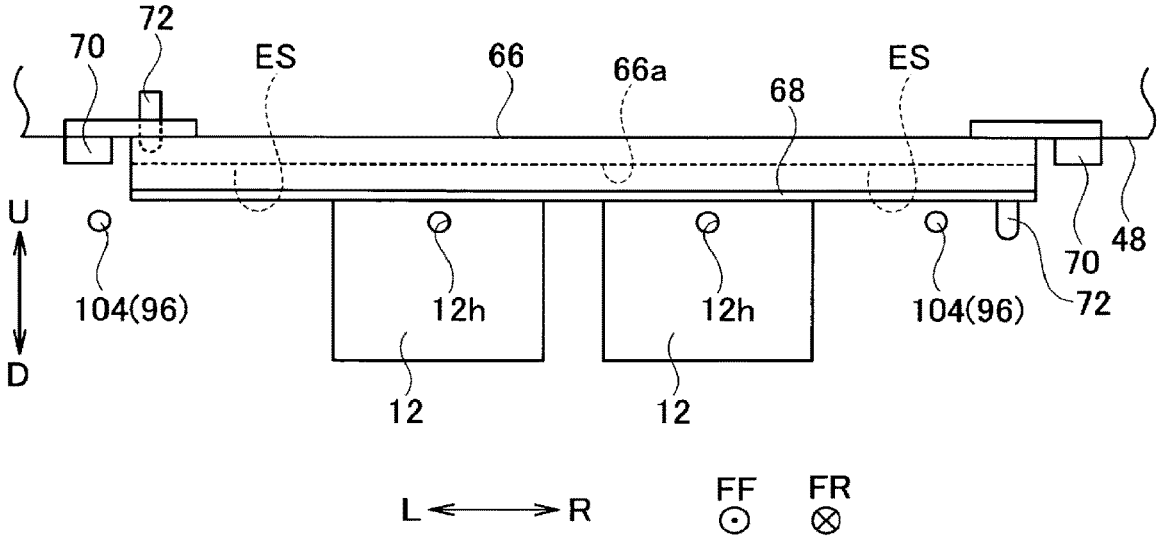
FIG. 7B(a) is a front view illustrating a misalignment correcting operation [before correction] in the upper stocker, and FIG. 7B(b) is a perspective view thereof.
Figure 7B:
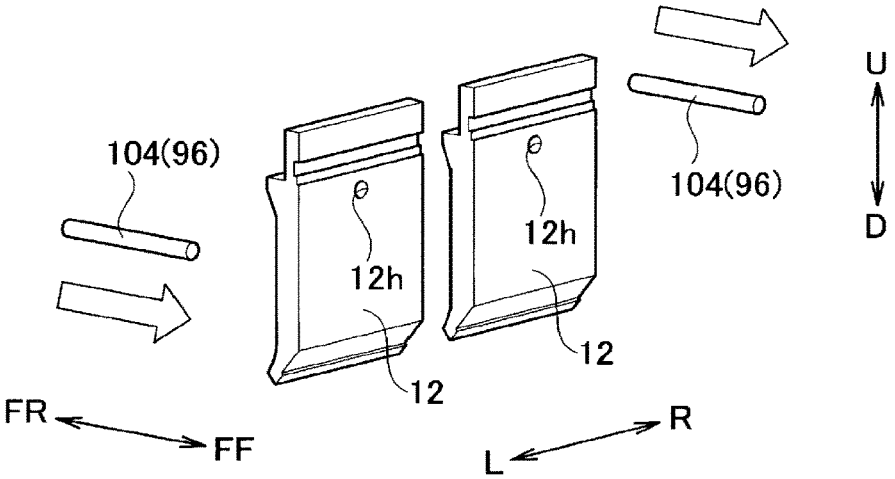

As illustrated in FIG. 3, FIG. 5 and FIG. 7B, the control device 132 controls the first servo motor 108 such that the first upper tool exchange unit 96 is located in the vicinity of the right vacant space ES, while obtaining the detection result of the first encoder 110. Subsequently, the control device 132 controls the first upper tool exchange unit 96 such that the upper tool retention member 104 of the first upper tool exchange unit 96 is moved forward with respect to the upper unit main body 98 so as to face the right side surface (one side surface) of the right punch tool 12 (punch tool 12 on the side opposite to the press brake 16). In addition, the control device 132 controls the second servo motor 108 such that the second upper tool exchange unit 96 is located in the vicinity of the left vacant space ES, while obtaining a detection result of the second encoder 110. Subsequently, the control device 132 controls the second upper tool exchange unit 96 such that the upper tool retention member 104 of the second upper tool exchange unit 96 is moved forward with respect to the upper unit main body 98 so as to face the left side surface (the other side surface) of the left punch tool 12 (punch tool 12 on the press brake 16 side) (see FIG. 7B(a) and FIG. 7B(b)).

Figure 7C:
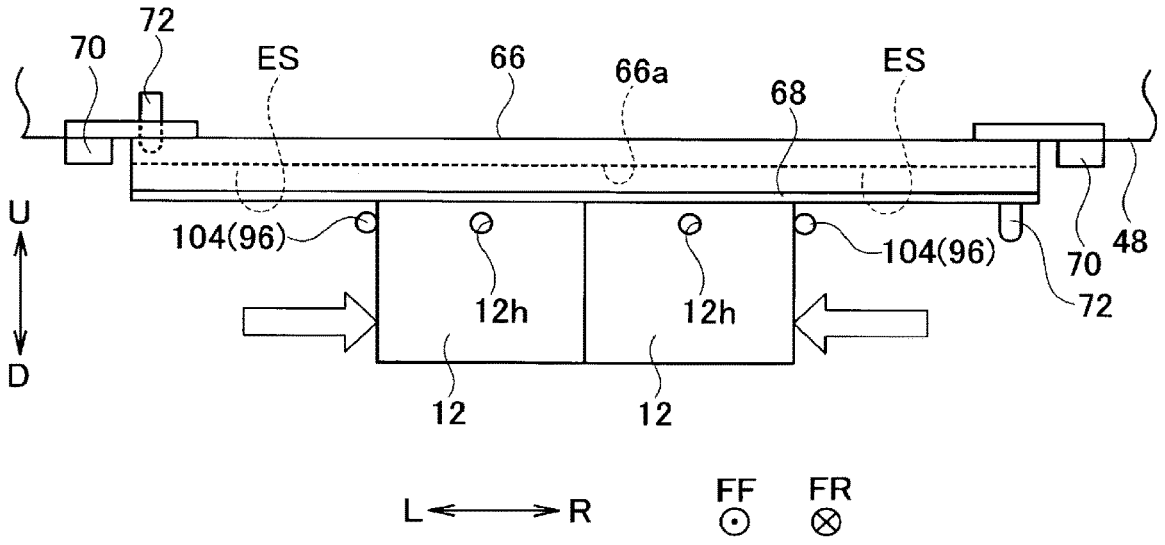
FIG. 7C(a) is a front view illustrating the misalignment correcting operation [after correction], and FIG. 7C(b) is a perspective view thereof.
Figure 7C:
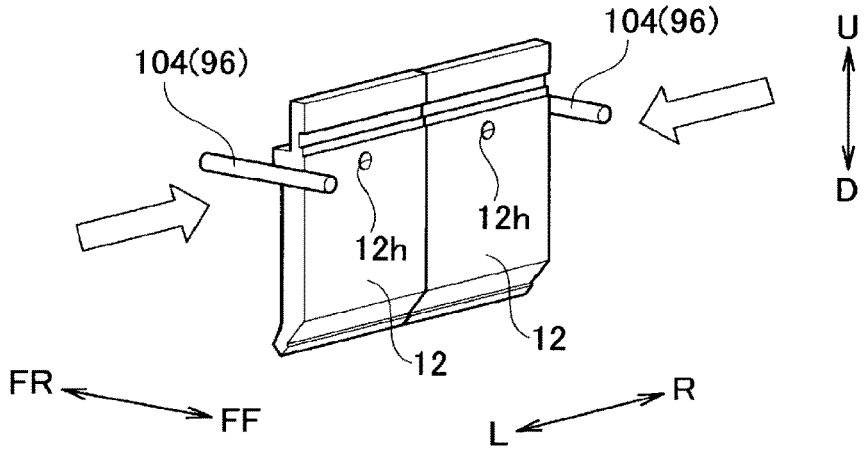

Thereafter, as illustrated in FIG. 3, FIG. 5 and FIG. 7C, the control device 132 controls the first servo motor 108 such that the upper tool retention member 104 of the first upper tool exchange unit 96 comes into contact with the right side surface of the right punch tool 12. The control device 132 controls the first servo motor 108 such that the first upper tool exchange unit 96 moves to the left (one side in the left-right direction) until the first upper tool exchange unit 96 reaches a position corresponding to one end of the regular arrangement position of the plurality of punch tools 12 while obtaining the detection result of the first encoder 110 under the contact state (see FIG. 7C(a) and FIG. 7C(b)).

In conjunction with the leftward movement of the first upper tool exchange unit 96, the control device 132 controls the second servo motor 108 such that the upper tool retention member 104 of the second upper tool exchange unit 96 comes into contact with the left side surface of the left punch tool 12. The control device 132 controls the second servo motor 108 such that the second upper tool exchange unit 96 moves to the right (the other side in the left-right direction) until the second upper tool exchange unit 96 reaches a position corresponding to the other end of the regular arrangement position of the plurality of punch tools 12 while obtaining the detection result of the second encoder 110 under the contact state (see FIG. 7C(a) and (b)).

The control device 132 executes the misalignment correcting operation of the punch tool 12 immediately before transporting the punch tool 12 from the upper stocker 66 positioned at the upper exchange position. Even when the number of the punch tools 12 held in the upper stocker 66 positioned at the upper exchange position is one, the control device 132 executes the misalignment correcting operation of the punch tool 12.

The control device 132 controls the lower tool exchange units 114 and the servo motors 128 in the same manner as described above even when the vacant space ES exists on one side or each of the both sides in the holder area 82*a* of the lower stocker 82 positioned at the lower exchange position.

Figure 8A:
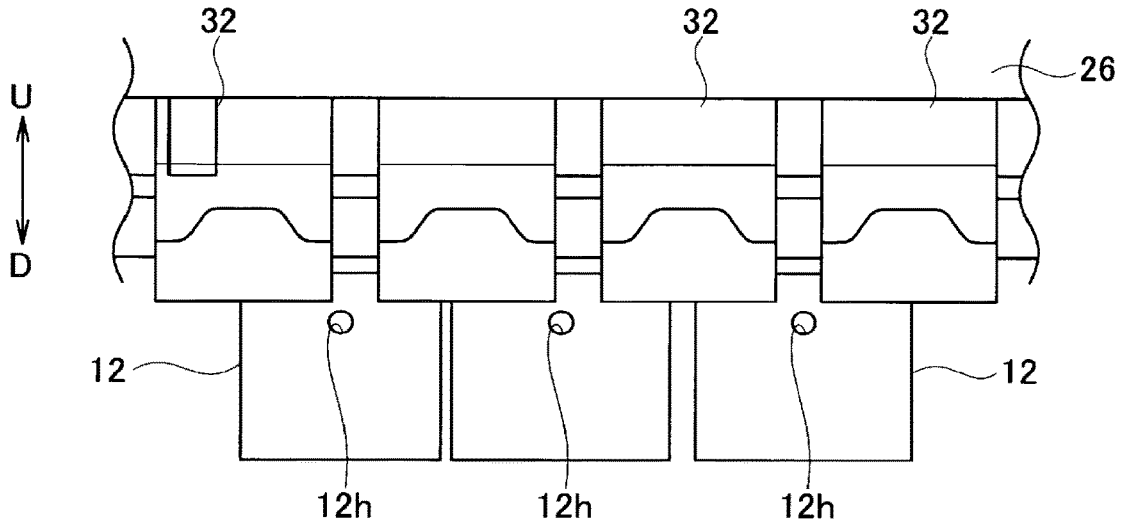
FIG. 8A(a) is a front view illustrating a state of misalignment of tools in upper tool holders of a press brake, and FIG. 8A(b) is a front view illustrating a state in which the misalignment is already corrected.
Figure 8A:
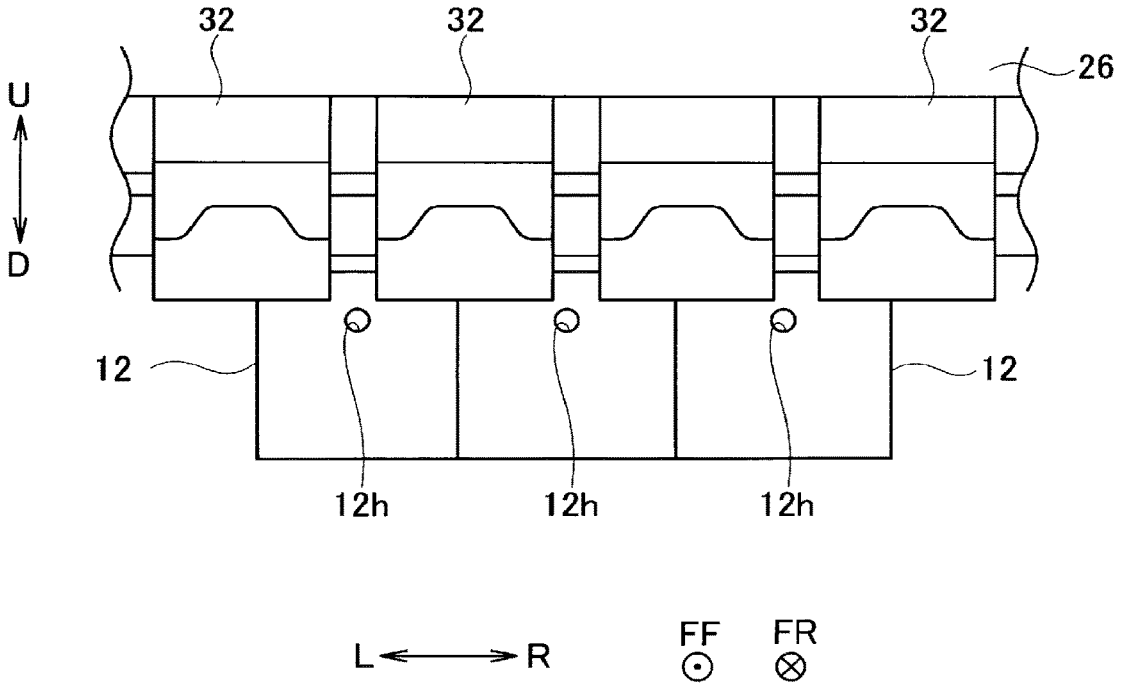

[C] As illustrated in FIG. 5 and FIG. 8A, the control device 132 executes the misalignment correcting operation of the punch tools 12 as follows in a case where the misalignment of the punch tools 12 held in the upper tool holders 30 occurs or is estimated to occur.

Herein, the case where the misalignment of the punch tools 12 occurs includes a case where a start command of the correcting operation is input to the control device 132 by the switch operation of an operator who finds the misalignment, and a case where the misalignment is detected by a visual sensor such as a camera.

The case where the misalignment of the punch tools 12 is estimated to occur includes a case where the number of times of bending using the punch tools 12 (the number of times of lowering of the upper table 26) reaches the set number of times. In this case, for example, it is notified that the number of times of machining reaches the set number of times, and the operator may input the start command of the correcting operation to the control device 132 by the switch operation (this is the above "case where misalignment occurs"). Additionally, the case where the misalignment is estimated to occur includes a case where the number of retries of the holding operation of the punch tools 12 by the upper tool retention member 104 reaches the predetermined number of times. The failure of the holding operation of the punch tools 12 by the upper tool retention member 104 is detected by a fact that the air cylinder 102 or 106 does not reach a stroke end during the holding operation.

Figure 8B:
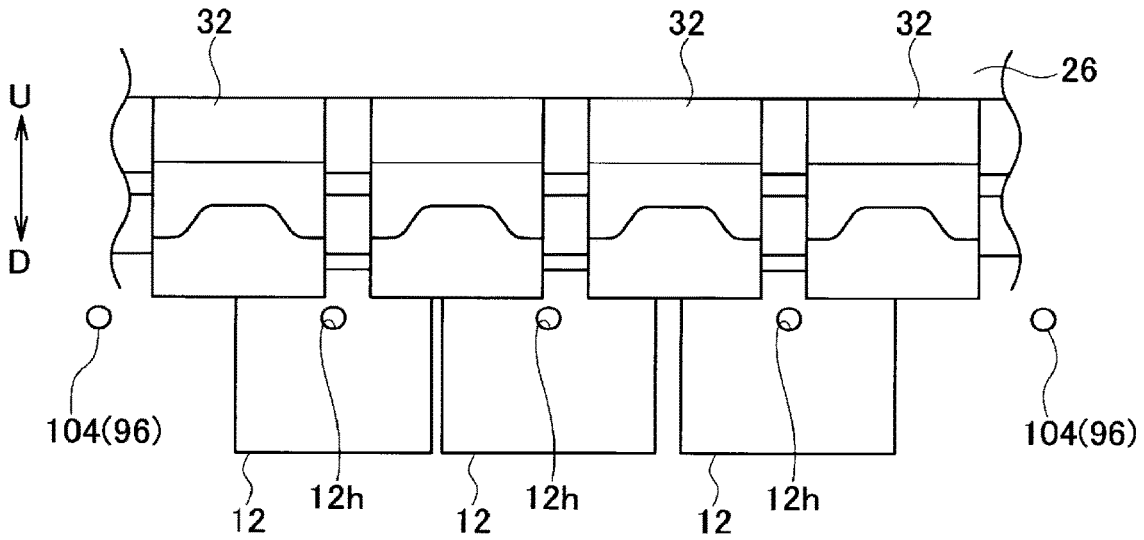
FIG. 8B(a) is a front view illustrating a misalignment correcting operation [before correction] in the upper tool holders, and FIG. 8B(b) is a front view illustrating the correcting operation [after correction].
Figure 8B:
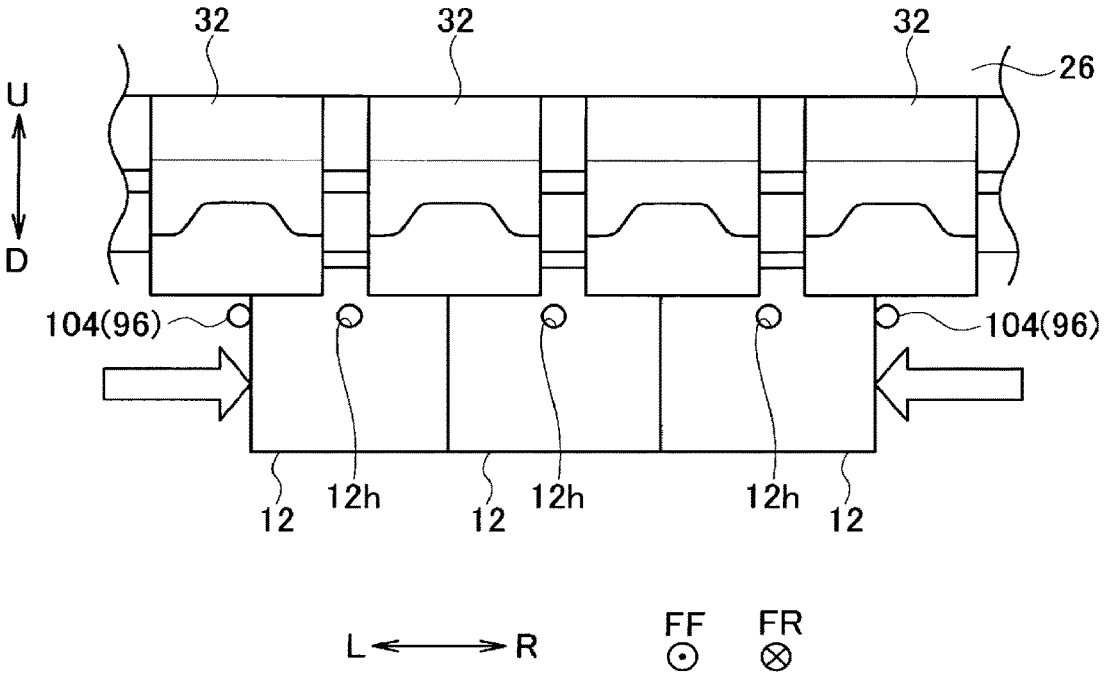

As illustrated in FIG. 1, FIG. 5 and FIG. 8B, the control device 132 controls the first servo motor 108 such that the first upper tool exchange unit 96 is located in the vicinity of the right side surface of the right punch tool 12 (punch tool 12 on the tool storage 56 side), while obtaining the detection result of the first encoder 110. Subsequently, the control device 132 controls the first upper tool exchange unit 96 such that the upper tool retention member 104 of the first upper tool exchange unit 96 is moved forward with respect to the upper unit main body 98 so as to face the right side surface of the right punch tool 12. Additionally, the control device 132 controls the second servo motor 108 such that the second upper tool exchange unit 96 is located in the vicinity of the left side surface of the left punch tool 12 (punch tool 12 on side opposite to the tool storage 56), while obtaining the detection result of the second encoder 110. The control device 132 controls the second upper tool exchange unit 96 such that the upper tool retention member 104 of the second upper tool exchange unit 96 is moved forward with respect to the upper unit main body 98 so as to face the left side surface of the left punch tool 12 (see FIG. 8B(a)).

Thereafter, the control device 132 controls the first servo motor 108 such that the upper tool retention member 104 of the first upper tool exchange unit 96 comes into contact with the right side surface of the right punch tool 12. The control device 132 controls the first servo motor 108 such that the first upper tool exchange unit 96 moves to the left until the first upper tool exchange unit 96 reaches a position corresponding to one end of the regular arrangement position of the plurality of punch tools 12 while obtaining the detection result of the first encoder 110 under the contact state. In conjunction with the leftward movement of the first upper tool exchange unit 96, the control device 132 controls the second servo motor 108 such that the upper tool retention member 104 of the second upper tool exchange unit 96 comes into contact with the left side surface of the left punch tool 12. The control device 132 controls the second servo motor 108 such that the second upper tool exchange unit 96 moves to the right until the second upper tool exchange unit 96 reaches a position corresponding to the other end of the regular arrangement position of the plurality of punch tools 12 while obtaining the detection result of the second encoder 110 under the contact state (see FIG. 8B(b)).

Figure 9A:
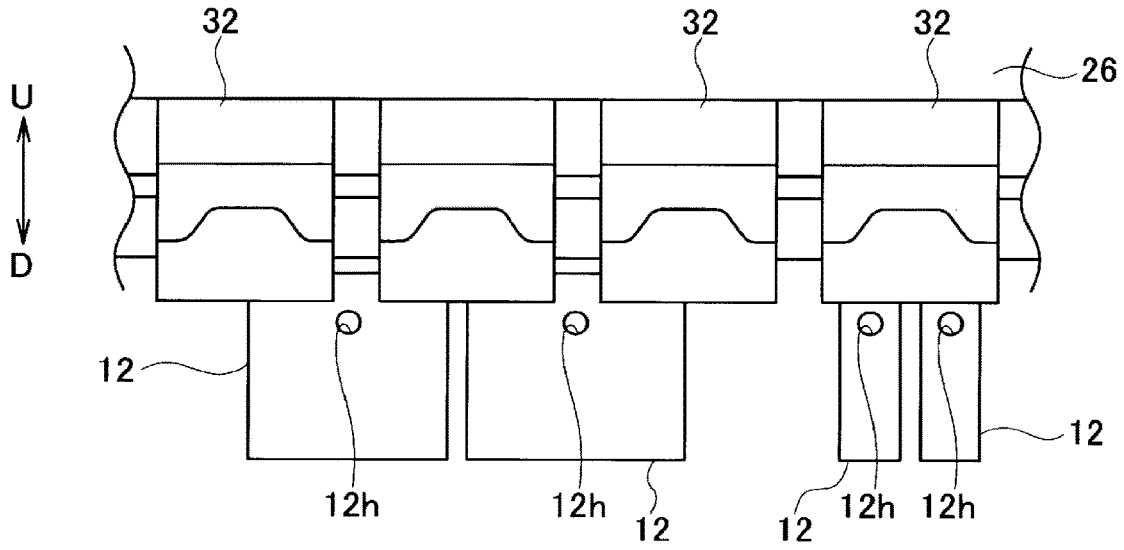
FIG. 9A(a) is a front view illustrating a state of misalignment of plural sets of tools held in the upper tool holders, and FIG. 9A(b) is a front view illustrating a state in which the misalignment is already corrected.
Figure 9A:
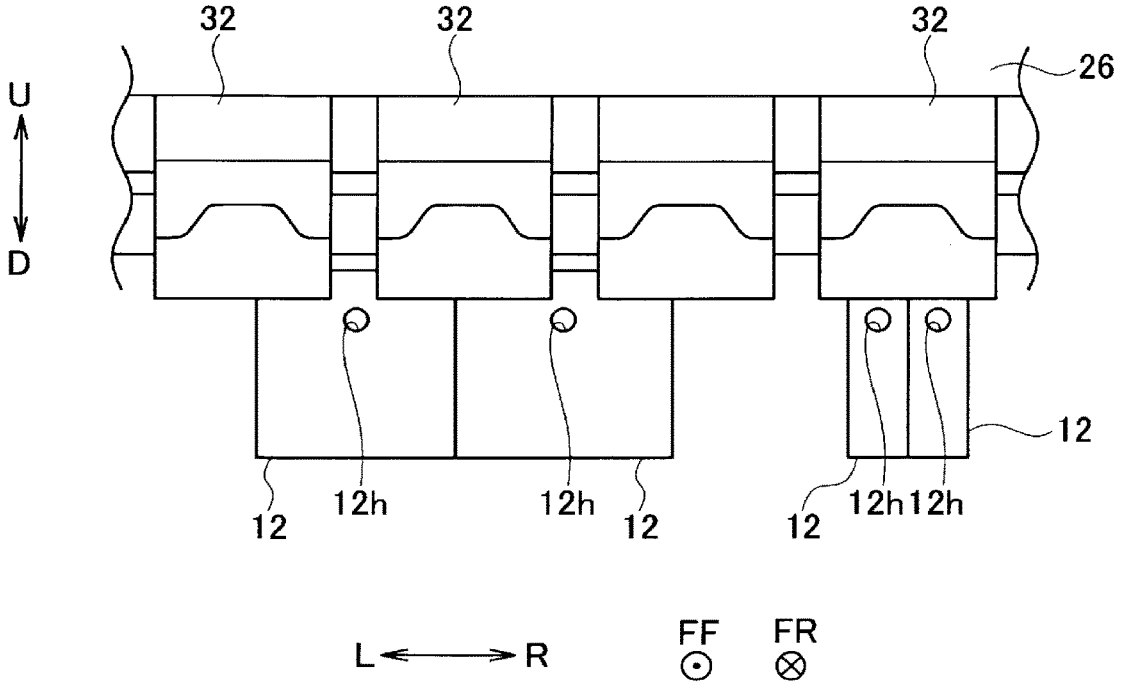

[D] As illustrated in FIG. 5 and FIG. 9A, when the misalignment of plural sets (two sets) of the punch tools 12 held at intervals in the left-right direction in the upper tool holders 30 occurs or is estimated to occur, the control device 132 executes the misalignment correcting operation of the punch tools 12 as follows. This correcting operation is executed on a condition that the upper tool retention member 104 can be inserted between (adjacent two sets of) the above plural sets. Whether or not the upper tool retention member 104 can be inserted between the plural sets is determined by the control device 132 on the basis of arrangement information of the punch tools 12 in the upper tool holders 30 included in the tool exchange program.

Figure 9B:
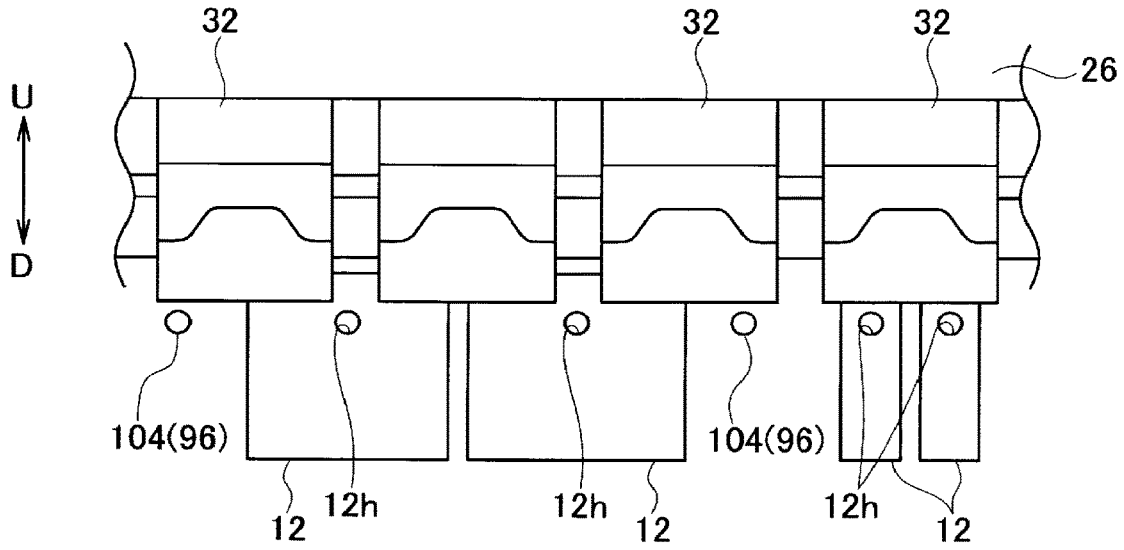
FIG. 9B(a) is a front view illustrating a misalignment correcting operation [before correction] in the upper tool holders, and FIG. 9B(b) is a front view of the misalignment correcting operation [during correction 1].
Figure 9B:
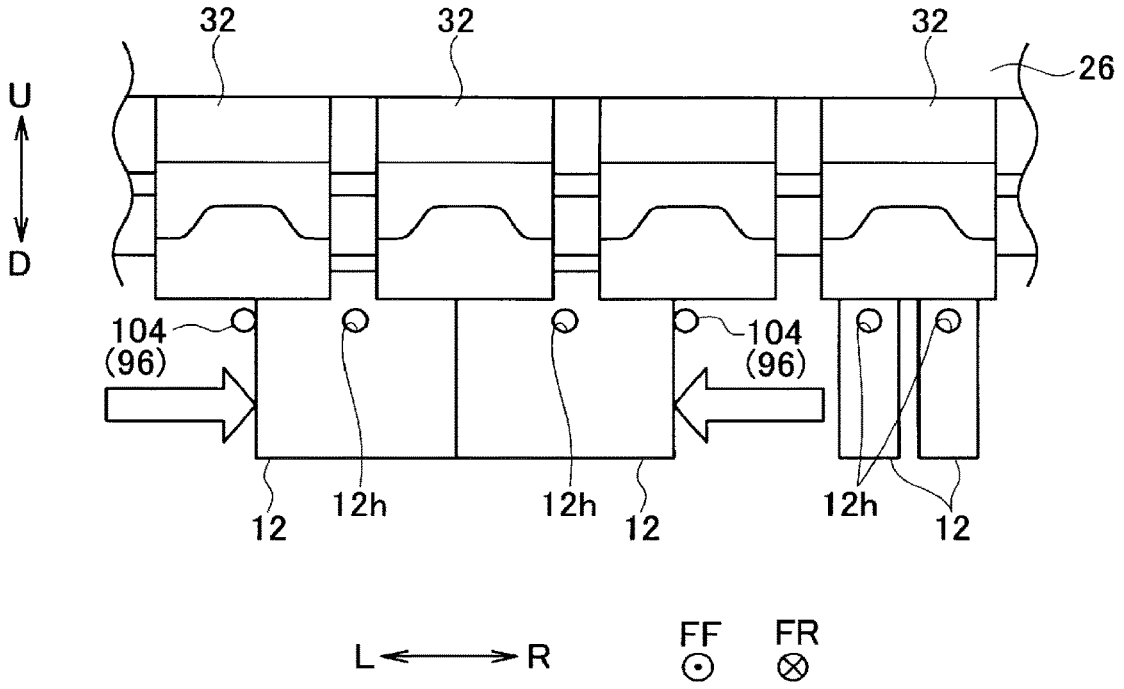

As illustrated in FIG. 1, FIG. 5 and FIG. 9B, the control device 132 controls the first servo motor 108 and the first upper tool exchange unit 96 such that the upper tool retention member 104 of the first upper tool exchange unit 96 comes into contact with the right side surface of the right punch tool 12 of any of the sets (first set). The control device 132 controls the first servo motor 108 such that the first upper tool exchange unit 96 moves to the left until the first upper tool exchange unit 96 reaches a position corresponding to one end of the regular arrangement position of the plurality of punch tools 12 of the first set under the contact state. In conjunction with the leftward movement of the first upper tool exchange unit 96, the control device 132 controls the second servo motor 108 and the second upper tool exchange unit 96 such that the upper tool retention member 104 of the second upper tool exchange unit 96 comes into contact with the left side surface of the left punch tool 12 of the first set. The control device 132 controls the second servo motor 108 such that the second upper tool exchange unit 96 moves to the right until the second upper tool exchange unit 96 reaches a position corresponding to the other end of the regular arrangement position of the plurality of punch tools 12 of the first set under the contact state (see FIG. 9B(a) and FIG. 9B(b)).

Figure 9C:
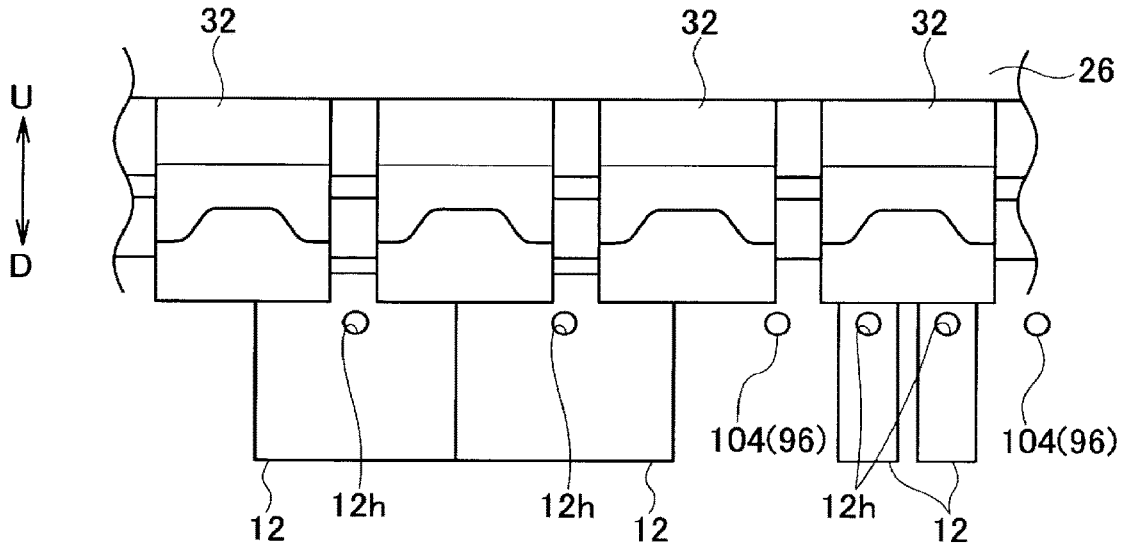
FIG. 9C(a) is a front view of the misalignment correcting operation [during correction 2], and FIG. 9C(b) is a front view of the misalignment correcting operation [after correction].
Figure 9C:
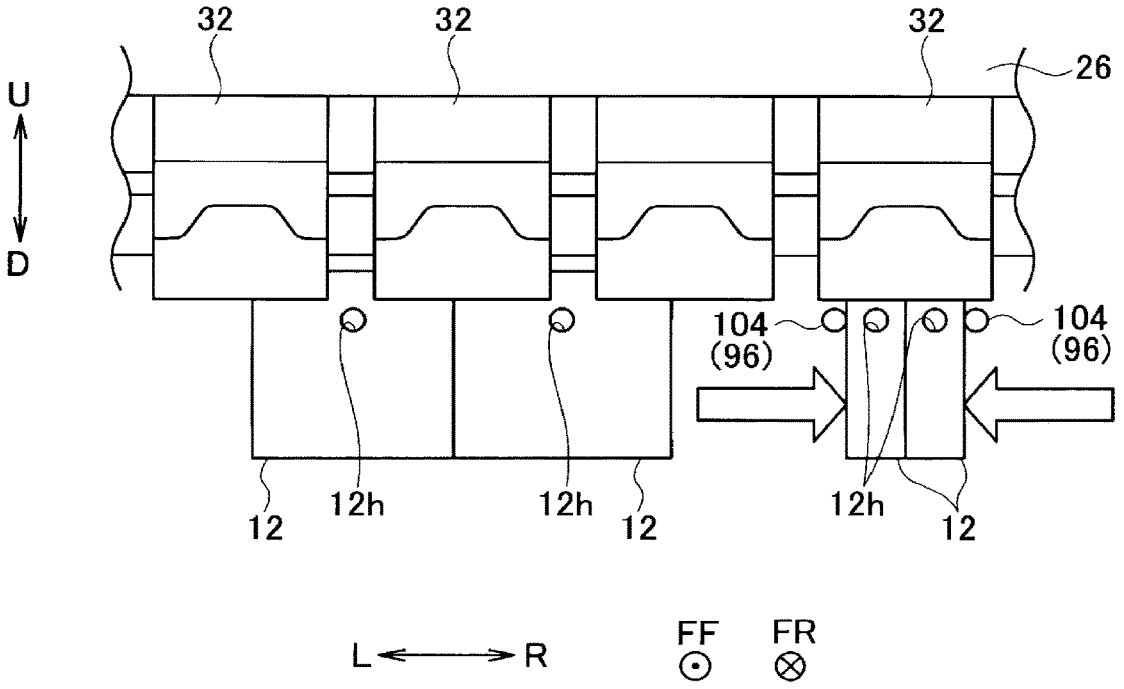

Thereafter, as illustrated in FIG. 1, FIG. 5 and FIG. 9C, the control device 132 controls the first servo motor 108 and the first upper tool exchange unit 96 such that the upper tool retention member 104 of the first upper tool exchange unit 96 comes into contact with the right side surface of the right punch tool 12 of the remaining set (second set). The control device 132 controls the first servo motor 108 such that the first upper tool exchange unit 96 moves to the left until the first upper tool exchange unit 96 reaches a position corresponding to one end of the regular arrangement position of the plurality of punch tools 12 of the second set under the contact state. In conjunction with the leftward movement of the first upper tool exchange unit 96, the control device 132 controls the second servo motor 108 and the second upper tool exchange unit 96 such that the upper tool retention member 104 of the second upper tool exchange unit 96 comes into contact with the left side surface of the left punch tool 12 of the second set. The control device 132 controls the second servo motor 108 such that the second upper tool exchange unit 96 moves to the right until the second upper tool exchange unit 96 reaches a position corresponding to the other end of the regular arrangement position of the plurality of punch tools 12 of the second set under the contact state (see FIG. 9C(a) and FIG. 9C(b)).

Figure 10A:
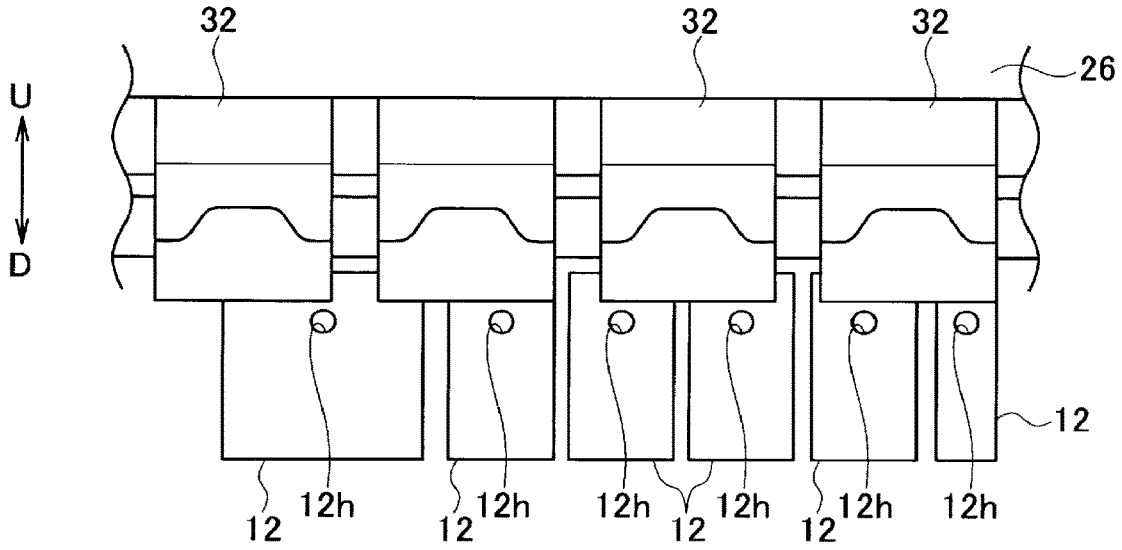
FIG. 10A(a) is a front view illustrating a state of misalignment of the tools in the upper tool holders of the press brake, and FIG. 10A(b) is a front view illustrating a state in which the misalignment is already corrected.
Figure 10A:
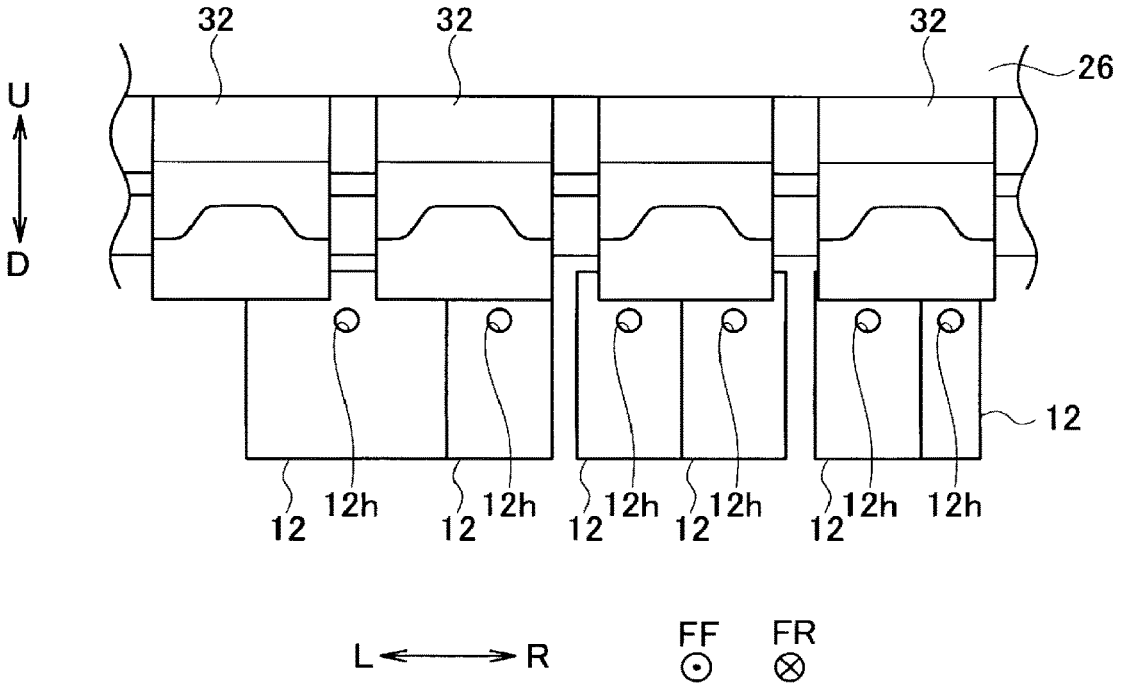

[E] As illustrated in FIG. 5 and FIG. 10A, when the misalignment of plural sets (three sets) of the punch tools 12 held at intervals in the left-right direction in the upper tool holders 30 occurs or is estimated to occur, the control device 132 executes the misalignment correcting operation of the punch tools 12 as follows. This correcting operation is executed on a condition that the upper tool retention member 104 cannot be inserted between (adjacent two sets of) the above plural sets.

Figure 10B:
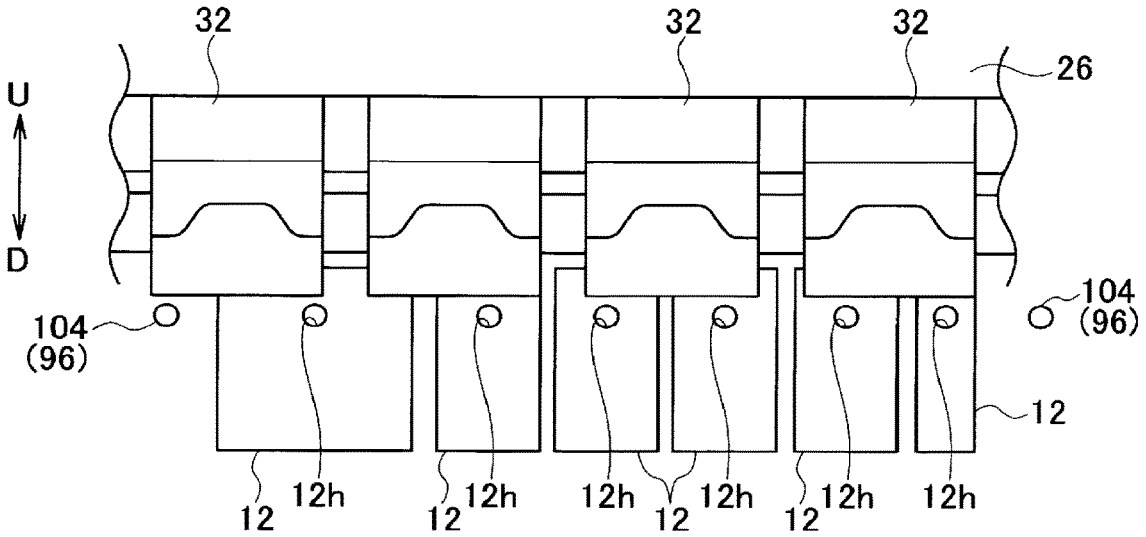
FIG. 10B(a) is a front view illustrating a misalignment correcting operation [before correction] in the upper tool holders, and FIG. 10B(b) is a front view illustrating the misalignment correcting operation [during correction 1].
Figure 10B:
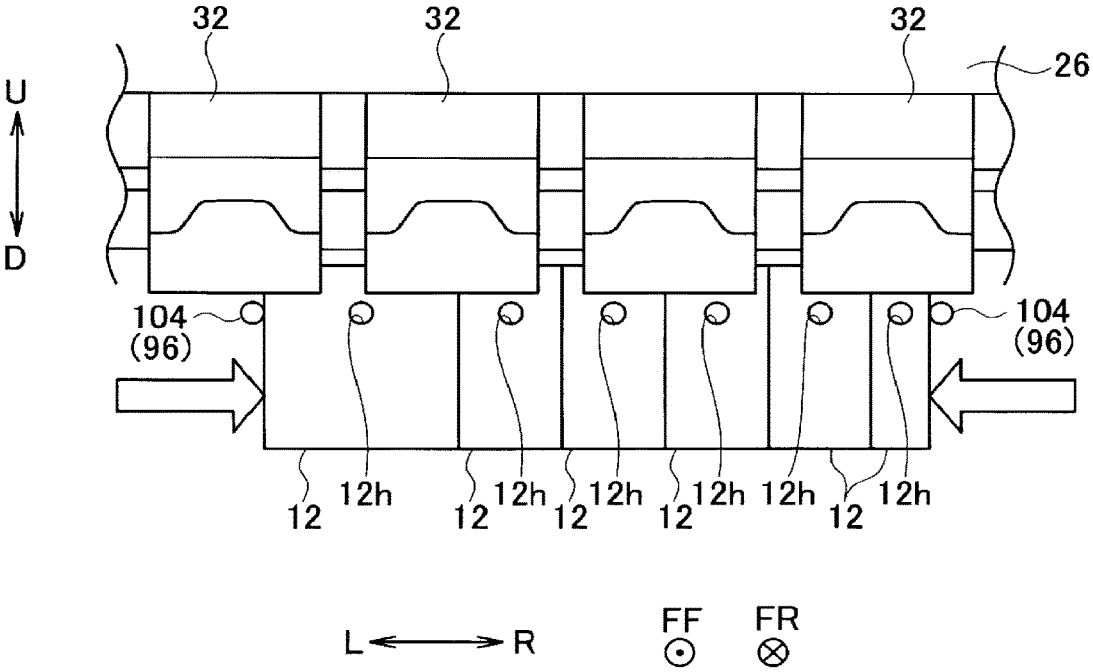

As illustrated in FIG. 1, FIG. 5 and FIG. 10B, the control device 132 controls the first servo motor 108 and the first upper tool exchange unit 96 such that the first upper tool exchange unit 96 faces the right side surface of the rightmost punch tool 12 (punch tool 12 on the tool storage 56 side). Additionally, the control device 132 controls the second servo motor 108 and the second upper tool exchange unit 96 such that the second upper tool exchange unit 96 faces the left side surface of the leftmost punch tool 12 (punch tool 12 on the side opposite to the tool storage 56) (see FIG. 10B(a)).

Subsequently, the control device 132 controls the first servo motor 108 such that the upper tool retention member 104 of the first upper tool exchange unit 96 comes into contact with the right side surface of the rightmost punch tool 12. The control device 132 controls the first servo motor 108 such that the first upper tool exchange unit 96 moves to the left until the first upper tool exchange unit 96 reaches a position corresponding to one end of a temporary arrangement position (temporary reference position) of all sets of the punch tools 12 under the contact state. In conjunction with the leftward movement of the first upper tool exchange unit 96, the control device 132 controls the second servo motor 108 such that the upper tool retention member 104 of the second upper tool exchange unit 96 comes into contact with the left side surface of the leftmost punch tool 12. The control device 132 controls the second servo motor 108 such that the second upper tool exchange unit 96 moves to the right until the second upper tool exchange unit 96 reaches a position corresponding to the other end of the temporary arrangement position of all sets of the punch tools 12 under the contact state (see FIG. 10B(b)).

Figure 10C:
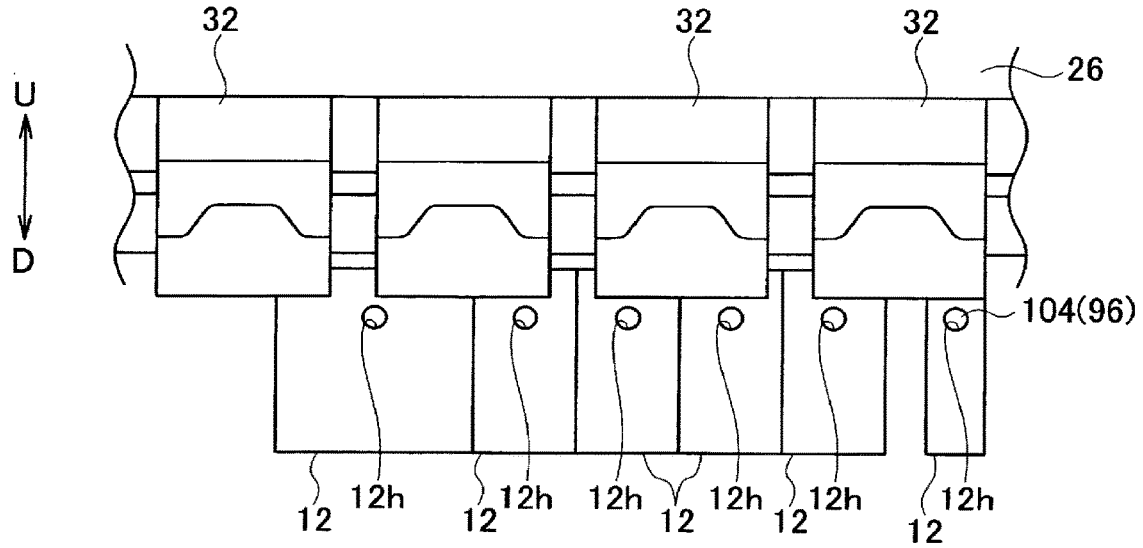
FIG. 10C(a) is a front view of the misalignment correcting operation [during correction 2], and FIG. 10C(b) is a front view of the misalignment correcting operation [after correction].
Figure 10C:
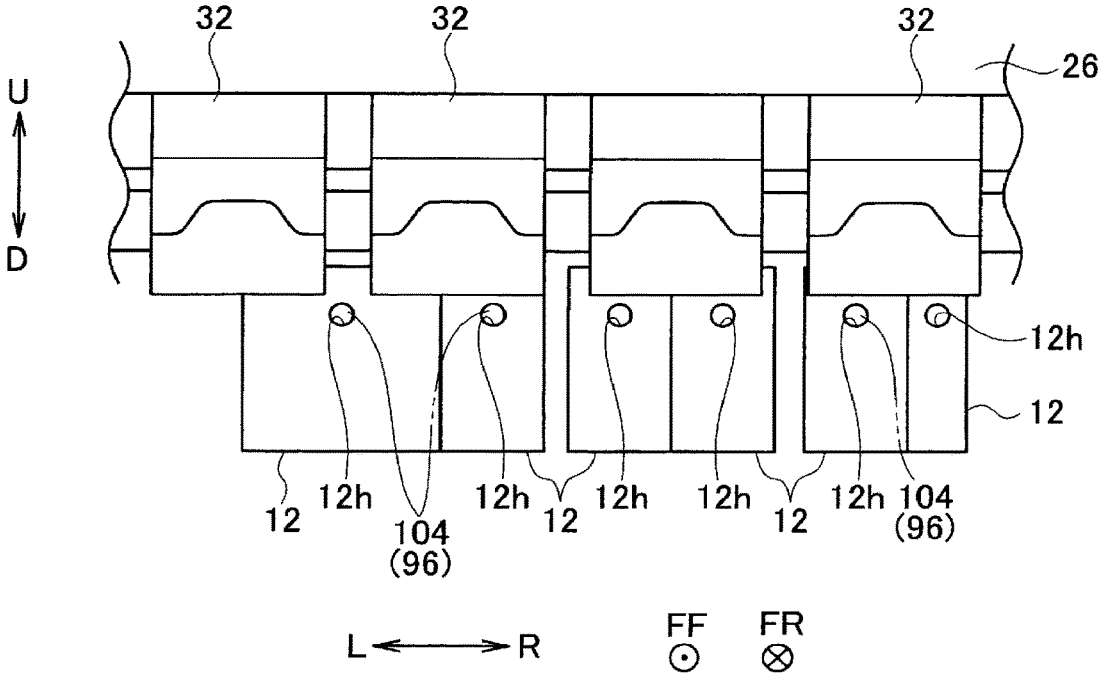

Thereafter, as illustrated in FIG. 1, FIG. 5 and FIG. 10C, the control device 132 controls the upper tool exchange unit 96 and the servo motor 108 such that the upper tool retention member 104 engages with the engagement hole 12*h* of any of the punch tools 12 (the rightmost tool 12 in FIG. 10C(a)). The control device 132 controls the upper tool exchange unit 96 and the servo motor 108 such that upper tool exchange unit 96 moves to the right (or the left) by a distance according to the difference between the regular arrangement position of this punch tool 12 and the above temporary arrangement position under the engagement state (see FIG. 10C(a)). Similarly, the control device 132 controls the upper tool exchange unit 96 and the servo motor 108 such that the upper tool retention member 104 engages with the engagement hole 12*h* of each one of the remaining punch tools 12 to be moved. The control device 132 controls the upper tool exchange unit 96 and the servo motor 108 such that the upper tool exchange unit 96 moves to the left or the right by a distance according to the difference between the regular arrangement position of the remaining punch tool 12 and the above temporary arrangement position under the engagement state (see FIG. 10C(b)). For example, after FIG. 10C(a), the second punch tool 12 from the right, the leftmost punch tool 12, and the second punch tool 12 from the left sequentially move to the regular arrangement position in this order. The temporary arrangement position of the two punch tools 12 in the middle coincide with the regular arrangement position of the two punch tools 12 in the middle.

Alternatively, the punch tools 12 may be moved to the regular arrangement position as follows. After FIG. 10B(b), the upper tool retention members 104 are engaged with the engagement holes 12*h* of the second and third punch tools 12 from the right. Thereafter, while the position of the third punch tool 12 from the right is held, the second punch tools 12 from the right is moved to the right toward the regular arrangement position together with the rightmost punch tool 12. Then, the upper tool retention members 104 are engaged with the engagement holes 12*h* of the second and third punch tools 12 from the left. Thereafter, while the position of the third punch tool 12 from the left is held, the second punch tool 12 from the left is moved to the right toward the regular arrangement position together with the leftmost punch tool 12.

Alternatively, the punch tools 12 may be moved to the regular arrangement position as follows. After FIG. 10B(b), the upper tool retention members 104 are engaged with the engagement holes 12*h* of the two right punch tools 12, and the two punch tools 12 are moved to the right toward the regular arrangement position at the same time. Next, the upper tool retention members 104 are engaged with the engagement holes 12*h* of the two left punch tools 12, and the two punch tools 12 are moved to the left toward the regular arrangement position at the same time.

Before executing the misalignment correcting operation of the punch tools 12, the control device 132 executes the unclamping operation of the front clamp plate 36 or the rear clamp plate 38. The control device 132 executes the clamping operation of the front clamp plate 36 or the rear clamp plate 38 after end of the misalignment correcting operation of the punch tools 12. Even when the number of the punch tools 12 held in the upper tool holders 30 is one, the control device 132 executes the misalignment correcting operation of the punch tool 12.

In the same manner as above, the control device 132 controls the lower tool exchange units 114 and the servo motors 128 also when the misalignment of the plural sets of the die tools 14 held in the lower tool holder 40 occurs or is estimated to occur.

Now, the automatic exchange operation of the tools 12 (14) by the bending system 10 will be described.

When the punch tools 12 are transported from the upper tool holders 30 to the upper stocker 66 positioned at the upper exchange position, the control device 132 controls the servo motors 108 such that the upper tool exchange units 96 move in the left-right direction, and the upper tool retention members 104 are aligned with the engagement holes 12*h* of the punch tools 12 mounted in the upper tool holders 30. Next, the upper tool retention members 104 are engaged with the engagement holes 12*h* of the punch tools 12 by the control device 132, so that the punch tools 12 are held by the upper tool retention members 104. The control device 132 controls the servo motors 108 such that the upper tool exchange units 96 move to the right, so that the punch tools 12 are transported to the right to be released from the upper tool holders 30. Further, the control device 132 controls the servo motors 108 such that the upper tool exchange units 96 move to the right, so that the punch tools 12 are transported to the right to be mounted on the upper stocker 66. Thereafter, the upper tool retention members 104 are released from the engagement holes 12*h* of the punch tools 12 by the control device 132, so that the holding state of the punch tools 12 by the upper tool retention members 104 is released.

After the punch tools 12 are released from the upper tool holders 30, the punch tools 12 may be moved to the back surface of the upper table 26 by the upper tool exchange units 96.

When the punch tools 12 are transported from the upper stocker 66 positioned at the upper exchange position to the upper tool holders 30, an operation in an order reverse to the above operation is performed. Consequently, automatic exchange of the punch tools 12 mounted on the upper tool holders 30 and the punch tools 12 mounted on the upper stocker 66 can be performed.

When the die tools 14 are transported between the lower tool holder 40 and the lower stocker 82 positioned at the lower exchange position, the same operation as described above is performed. Consequently, automatic exchange of the die tools 14 mounted on the lower tool holder 40 and the die tools 14 mounted on the lower stocker 82 can be performed.

When the die tools 14 are mounted on (released from) the lower tool holder 40 or the lower stocker 82, the die tools 14 may be vertically moved by the lower tool exchange unit 114.

Subsequently, effects of this embodiment will be described including contents of a correcting method for tool misalignment according to this embodiment. The correcting method for tool misalignment according to this embodiment is a method for correcting the misalignment of the tool 12 (14) in the stocker 66 (82) positioned at the exchange position or the tool holder 30 (40).

[A] As illustrated in FIG. 5 and FIG. 6A, when the vacant space ES exists on only one side in the holder area 66*a* of the upper stocker 66 positioned at the upper exchange position (see FIG. 6A(a)), the control device 132 executes the following misalignment correcting operation by controlling the first upper tool exchange unit 96 and the first servo motor 108.

As illustrated in FIG. 3, FIG. 5, FIG. 6B and FIG. 6C, the first upper tool exchange unit 96 moves in the left-right direction, and is located in the vicinity of the vacant space ES. Subsequently, the upper tool retention member 104 of the first upper tool exchange unit 96 moves forward with respect to the upper unit main body 98 and faces the side surface of the left punch tool 12. Furthermore, the first upper tool exchange unit 96 moves to the right, and brings the upper tool retention member 104 of the first upper tool exchange unit 96 into contact with the side surface of the left punch tool 12. The first upper tool exchange unit 96 moves in the right direction until the side surface of the right punch tool 12 abuts on the stopper 72 under the contact state. Consequently, the plurality of punch tools 12 can be positioned at the regular arrangement position in the upper stocker 66. That is, even when the misalignment of the plurality of punch tools 12 occurs in the upper stocker 66 positioned at the upper exchange position, it is possible to correct the misalignment.

[B] As illustrated in FIG. 5 and FIG. 7A, when the vacant spaces ES exist on the both sides in the holder area 66*a* of the upper stocker 66 positioned at the upper exchange position (see FIG. 7A(a)), the control device 132 executes the following misalignment correcting operation by controlling the upper tool exchange units 96 and the servo motors 108.

As illustrated in FIG. 3, FIG. 5, FIG. 7B and FIG. 7C, the first upper tool exchange unit 96 moves to the right and is located in the vicinity of the right vacant space ES, and the second upper tool exchange unit 96 moves to the left and is located in the vicinity of the left vacant space ES (see FIG. 7B(a) and FIG. 7B(b)). Subsequently, the upper tool retention member 104 of the first upper tool exchange unit 96 moves forward, and faces the right side surface of the right punch tool 12. The upper tool retention member 104 of the second upper tool exchange unit 96 moves forward, and faces the left side surface of the punch tool 12 on the press brake 16 side (left).

Thereafter, the first upper tool exchange unit 96 moves to the left, and the upper tool retention member 104 of the first upper tool exchange unit 96 comes into contact with the right side surface of the right punch tool 12. The first upper tool exchange unit 96 moves to the left until the first upper tool exchange unit 96 reaches the position corresponding to one end of the regular arrangement position of the plurality of punch tools 12 in the upper stocker 66 under the contact state (see FIG. 7C(a) and FIG. 7C(b)). In conjunction with the leftward movement of the first upper tool exchange unit 96, the second upper tool exchange unit 96 moves to the right, and the upper tool retention member 104 of the second upper tool exchange unit 96 comes into contact with the left side surface of the left punch tool 12. The second upper tool exchange unit 96 moves to the right until the second upper tool exchange unit 96 reaches the position corresponding to the other end of the regular arrangement position of the plurality of punch tools 12 in the upper stocker 66 under the contact state (see FIG. 7C(a) and FIG. 7C(b)). Consequently, the plurality of punch tools 12 can be positioned at the regular arrangement position in the upper stocker 66. That is, even when the misalignment of the plurality of punch tools 12 occurs in the upper stocker 66 positioned at the upper exchange position, it is possible to correct the misalignment.

The control device 132 controls the lower tool exchange units 114 and the servo motors 128 and executes the correcting operation in the same manner as described even when the vacant space exists on the one side or each of the both sides in the holder area 82*a* of the lower stocker 82 positioned at the lower exchange position. Consequently, even when the misalignment of the plurality of die tools 14 occurs in the lower stocker 82 positioned at the lower exchange position, it is possible to correct the misalignment.

[C] As illustrated in FIG. 5 and FIG. 8A, the control device 132 executes the following misalignment correcting operation by controlling the upper tool exchange units 96 and the servo motors 108 when the misalignment of the punch tools 12 held in the upper tool holders 30 occurs or is estimated to occur.

As illustrated in FIG. 5 and FIG. 8B, the first upper tool exchange unit 96 moves in the left-right direction, and is located in the vicinity of the right side surface of the right punch tool 12. Subsequently, the upper tool retention member 104 of the first upper tool exchange unit 96 moves forward with respect to the upper unit main body 98, and faces the right side surface of the right punch tool 12. Additionally, the second upper tool exchange unit 96 moves in the left-right direction, and is located in the vicinity of the left side surface of the left punch tool 12. Subsequently, the upper tool retention member 104 of the second upper tool exchange unit 96 moves forward with respect to the upper unit main body 98, and faces the left side surface of the left punch tool 12 (see FIG. 8B(a)).

Thereafter, the first upper tool exchange unit 96 moves to the left, and the upper tool retention member 104 of the first upper tool exchange unit 96 comes into contact with the right side surface of the right punch tool 12. The first upper tool exchange unit 96 moves to the left until the first upper tool exchange unit 96 reaches the position corresponding to the one end of the regular arrangement position of the plurality of punch tools 12 in the upper tool holders 30 under the contact state. In conjunction with the leftward movement of the first upper tool exchange unit 96, the second upper tool exchange unit 96 moves to the right, and the upper tool retention member 104 of the second upper tool exchange unit 96 comes into contact with the left side surface of the left punch tool 12. The second upper tool exchange unit 96 moves in the right direction until the second upper tool exchange unit 96 reaches the position corresponding to the other end of the regular arrangement position of the plurality of punch tools 12 in the upper tool holders 30 under the contact state (see FIG. 8B(b)). Consequently, the plurality of punch tools 12 can be positioned at the regular arrangement positions in the upper tool holders 30. That is, even when the misalignment of the plurality of punch tools 12 occurs in the upper tool holders 30, it is possible to correct the misalignment.

[D] As illustrated in FIG. 5 and FIG. 9A, when the misalignment of plural sets of the punch tools 12 held at intervals in the left-right direction in the upper tool holders 30 occurs or is estimated to occur, the control device 132 executes the following correcting operation by controlling the upper tool exchange units 96 and the servo motors 108. This correcting operation is executed on a condition that the upper tool retention member 104 can be inserted between (adjacent two sets of) the above plural sets.

As illustrated in FIG. 5 and FIG. 9B, the upper tool retention member 104 of the first upper tool exchange unit 96 comes into contact with the right side surface of the right punch tool 12 of any of the sets (first set). The first upper tool exchange unit 96 moves to the left until the first upper tool exchange unit 96 reaches the position corresponding to the one end of the regular arrangement position of the plurality of punch tools 12 of the first set in the upper tool holders 30 under the contact state. In conjunction with the leftward movement of the first upper tool exchange unit 96, the upper tool retention member 104 of the second upper tool exchange unit 96 comes into contact with the left side surface of the left punch tool 12 of the first set. The second upper tool exchange unit 96 moves to the right until the second upper tool exchange unit 96 reaches the position corresponding to the other end of the regular arrangement position of the plurality of punch tools 12 of the first set in the upper tool holders 30 under the contact state (see FIG. 9B(a) and FIG. 9B(b)). Consequently, the plurality of punch tools 12 of the first set can be positioned at the regular arrangement position in the upper tool holders 30.

Thereafter, as illustrated in FIG. 5 and FIG. 9C, the upper tool retention member 104 of the first upper tool exchange unit 96 comes into contact with the right side surface of the right punch tool 12 of the remaining set (second set). The first upper tool exchange unit 96 moves to the left until the first upper tool exchange unit 96 reaches the position corresponding to the one end of the regular arrangement position of the plurality of punch tools 12 of the second set in the upper tool holders 30 under the contact state. In conjunction with the leftward movement of the first upper tool exchange unit 96, the upper tool retention member 104 of the second upper tool exchange unit 96 comes into contact with the left side surface of the left punch tool 12 of the second set. The second upper tool exchange unit 96 moves to the right until the second upper tool exchange unit 96 reaches the position corresponding to the other end of the regular arrangement position of the plurality of punch tools 12 of the second set in the upper tool holders 30 under the contact state (see FIG. 9C(a) and FIG. 9C(b)). Consequently, the plurality of punch tools 12 of the second set can be positioned at the regular arrangement position in the upper tool holder 30. Even when the number of the plural sets is three or more, three or more sets of the punch tools can be positioned, similarly. That is, even when the misalignment of plural sets of the punch tools 12 occurs in the upper tool holders 30, it is possible to correct the misalignment.

[E] As illustrated in FIG. 5 and FIG. 10A, when the misalignment of plural sets of the punch tools 12 held at intervals in the left-right direction in the upper tool holders 30 occurs or is estimated to occur, the control device 132 executes the misalignment correcting operation of the punch tools 12 in the upper tool holders 30 as follows. This correcting operation is executed on a condition that the upper tool retention member 104 cannot be inserted between (adjacent two sets of) the plural sets of the punch tools 12.

As illustrated in FIG. 5 and FIG. 10B, the upper tool retention member 104 of the first upper tool exchange unit 96 comes into contact with the right side surface of the right punch tool 12. The first upper tool exchange unit 96 moves to the left until the first upper tool exchange unit 96 reaches the position corresponding to the one end of a temporary arrangement position (temporary reference position) of plural sets of the punch tools 12 in the upper tool holders 30 under the contact state. In conjunction with the leftward movement of the first upper tool exchange unit 96, the upper tool retention member 104 of the second upper tool exchange unit 96 comes into contact with the left side surface of the leftmost punch tool 12. The second upper tool exchange unit 96 moves to the right until the second upper tool exchange unit 96 reaches the position corresponding to the other end of the temporary arrangement position of plural sets of the punch tools 12 in the upper tool holders 30 under the contact state (see FIG. 10B(a) and FIG. 10B(b)).

Thereafter, as illustrated in FIG. 5 and FIG. 100, the upper tool retention member 104 engages with the engagement holes 12*h* of any of the punch tools 12. The upper tool exchange unit 96 moves in the left-right direction by the distance according to the difference between the regular arrangement position of this punch tool 12 in the upper tool holder 30 and (the temporary arrangement position of this punch tool 12 at) the temporary arrangement position of the plurality of punch tools 12 under the engagement state (see FIG. 10C(a)). Consequently, a plurality of the punch tools 12 of this set can be positioned at the regular arrangement positions in the upper tool holders 30.

Similarly, the upper tool retention member 104 engages with the engagement hole 12*h* of the remaining punch tool 12. The upper tool exchange unit 96 moves in the left-right direction by the distance according to the difference between the regular arrangement position of the remaining punch tools 12 in the upper tool holders 30 and (the temporary arrangement position of this remaining punch tool 12 at) the temporary arrangement position of the plurality of punch tools 12 under the engagement state (see FIG. 100(*b*)). Consequently, a plurality of the punch tools 12 of the remaining set can be positioned at the regular arrangement position in the upper tool holders 30. Even when the number of the plural sets is two or four or more, two or four or more sets of the punch tools can be positioned similarly. That is, even when the misalignment of the plural sets of the punch tools 12 occurs in the upper tool holders 30, it is possible to correct the misalignment.

Even when the misalignment of plural sets of the die tools 14 held in the lower tool holder 40 occurs or is estimated to occur, the control device 132 executes the correcting operation by controlling the lower tool exchange units 114 and the servo motors 128 in the same manner as described above. Consequently, even when the misalignment of the plurality of die tools 14 occurs in the lower tool holder 40, it is possible to correct the misalignment.

Therefore, according to this embodiment, the automatic exchange operation of the punch tools 12 and the automatic exchange operation of the die tools 14 can be stably performed by the bending system 10.

The present invention is not limited to the description of the above embodiment, and can be implemented in various embodiments as follows, for example.

In the above embodiment, the tool exchange units 96 (114) are provided on the back side of the table 26 (24) so as to be movable in the left-right direction. The tool exchange unit 96 (114) may be provided on the front side of the table 26 (24) so as to be movable in the left-right direction. The location of the tool storage 56 may be other than the lateral side in the left-right direction of the press brake 16 as long as the location is in the vicinity of the press brake 16.

The scope of rights included in the present invention is not limited to the above embodiments.

The invention claimed is:

1. A bending system comprising:

a tool storage including a plurality of stockers, the tool storage disposed adjacent a press brake and each of the plurality of stockers for storing a respective plurality of tools, a respective holder area being formed on each of the plurality of stockers for holding the respective plurality of tools therein such that the respective plurality of tools are aligned with a lateral direction, and the tool storage being configured to position a selected stocker from the plurality of stockers at an exchange position for exchanging the respective plurality of tools stored on the selected stocker;

a tool exchange unit provided on a back side or a front side of a table of the press brake so as to be movable in the lateral direction, the tool exchange unit including a tool retention member that is engageable-with and disengageable-from an engagement hole of a selected tool of the respective plurality of tools stored on the selected stocker to hold the selected tool, the tool exchange unit being configured to exchange the selected tool with respect to a tool holder of the press brake and the selected stocker positioned at the exchange position;

a moving actuator configured to move the tool exchange unit in the lateral direction; and a control device configured to control, in a case where a vacant space exists on only one side in the respective holder area of the selected stocker positioned at the exchange position, the tool exchange unit and the moving actuator to move the tool exchange unit in the lateral direction to bring the tool retention member into contact with a first face of the selected tool of the respective plurality of tools stored on the selected stocker from the vacant space, and to move the respective plurality of tools in the lateral direction until the respective plurality of tools abut a stopper that is provided at a position corresponding to one end of a designated arrangement position in the selected stocker, wherein the first face of the selected tool of the respective plurality of tools extends in a first vertically-extending plane, and a second face of the selected tool through which the engagement hole of the selected tool is formed extends in a second vertically-extending plane, the first vertically-extending plane and the second vertically-extending plane extending orthogonal to one another.

2. A correcting method for tool misalignment in the bending system of claim 1, the method comprising:

providing the bending system of claim 1; and moving, in the case where the vacant space exists on only one side in the respective holder area of the selected stocker positioned at the exchange position, the tool exchange unit in the lateral direction to bring the tool retention member into contact with the first face of the selected tool of the respective plurality of tools stored on the selected stocker from the vacant space, and moving the respective plurality of tools in the lateral direction until the respective plurality of tools abut the stopper.

* * * * *